US009737825B2

(12) United States Patent
Donohoe

(10) Patent No.: US 9,737,825 B2
(45) **Date of Patent: *Aug. 22, 2017**

(54) BUILDING TOY

(71) Applicant: Mark Donohoe, St. Louis, MO (US)

(72) Inventor: Mark Donohoe, St. Louis, MO (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/144,382

(22) Filed: May 2, 2016

(65) Prior Publication Data

US 2016/0317938 A1 Nov. 3, 2016

Related U.S. Application Data

(63) Continuation-in-part of application No. 14/620,964, filed on Feb. 12, 2015, now Pat. No. 9,327,206.

(60) Provisional application No. 61/986,260, filed on Apr. 30, 2014.

(51) Int. Cl.
*A63H 33/08* (2006.01)
*A63H 33/04* (2006.01)

(52) U.S. Cl.
CPC ..... *A63H 33/044* (2013.01); *A63H 33/08* (2013.01); *A63H 33/084* (2013.01)

(58) Field of Classification Search
USPC ..... 446/105, 106, 108, 110, 111, 124, 125; 52/233
See application file for complete search history.

(56) References Cited

U.S. PATENT DOCUMENTS

| | | | | |
|---|---|---|---|---|
| 1,271,160 | A * | 7/1918 | Groves | A63H 33/044 446/106 |
| 1,351,086 | A | 8/1920 | Wright | |
| 1,402,438 | A | 1/1922 | Nichols | |
| 2,012,160 | A | 8/1935 | Forbes | |
| 2,059,598 | A | 11/1936 | Paulson | |
| 2,104,742 | A | 1/1938 | Fleischer | |
| 2,110,990 | A * | 3/1938 | Forbes | A63H 33/04 446/106 |
| 2,712,199 | A | 7/1955 | Latimer | |
| 2,946,150 | A | 7/1960 | Houk | |
| 3,257,762 | A | 6/1966 | Steiner | |
| 4,270,304 | A | 6/1981 | Sofer | |
| 4,372,076 | A | 2/1983 | Beck | |
| 4,391,067 | A * | 7/1983 | Frady | E04B 2/702 52/233 |
| 5,145,440 | A | 9/1992 | Boris et al. | |
| 5,174,078 | A | 12/1992 | West | |
| 5,281,181 | A | 1/1994 | McCollum | |
| 5,354,223 | A | 10/1994 | Wawzonek | |
| 5,846,114 | A | 12/1998 | Frandsen, II | |

(Continued)

*Primary Examiner* — Kurt Fernstrom
(74) *Attorney, Agent, or Firm* — Lewis Rice LLC

(57) ABSTRACT

A building toy and a method of building with it. The toy is designed to be constructed of a rigid and generally non-deformable material such as but not limited to, wood and particularly hardwood, and is constructed in the fashion of a log-style building toy. The toy utilizes interconnecting notches in its construction, but provides for a variety of specialized pieces which allow for interconnection of parts where there is one notch but not another, as well as the ability to build roofs, floors, and specialty structures such as fireplaces through the use of specialized components. Further, the use of more strongly connecting components allows for stronger structures to be built.

3 Claims, 35 Drawing Sheets

(56) References Cited

U.S. PATENT DOCUMENTS

| | | | | |
|---|---|---|---|---|
| 6,059,630 | A | 5/2000 | Paxton et al. | |
| 6,094,876 | A | 8/2000 | Ogo et al. | |
| 6,146,232 | A | 11/2000 | Robbins | |
| 6,189,271 | B1 | 2/2001 | Christensen | |
| D466,166 | S | 11/2002 | George | |
| 6,923,705 | B2 | 8/2005 | DeSalvo et al. | |
| 7,044,824 | B2 | 5/2006 | Chavez | |
| 8,105,127 | B2 | 1/2012 | Heston | |
| 8,695,295 | B2 * | 4/2014 | Thornton | E04C 3/14 446/106 |

* cited by examiner

BUILDING TOY

CROSS REFERENCE TO RELATED APPLICATION(S)

This application is a Continuation-in-Part of (CIP) U.S. Utility patent application Ser. No. 14,620,964 filed Feb. 12, 2015. and now U.S. Pat. No. 9,327,206 which in turn claims benefit of U.S. Provisional Patent Application Ser. No. 61/986,260 filed Apr. 30, 2014. The entire disclosure of all the above applications is herein incorporated by reference.

BACKGROUND

1. Field of the Invention

This disclosure is related to a building toy. Specifically, it is directed to a log-style building to comprising a plurality of interlocking rigid pieces.

2. Description of the Related Art

Building toys have always been very popular with children. The ability to construct structures and other items which can then be played with can provide for hours of entertainment. Further, budding toys are often considered very educational. As opposed to simpler toys such as dolls, plush toys, or miniature cars where play is limited to using the toy in a fashion that comports with its real world counterpart, building toys can often be constructed into a near limitless array of items.

Today there are a wide variety of building toys on the market. The most well-known, and also most versatile, are brick toys such as the Lego™ Brick. This toy provides a huge array of different pieces and colors and has been used not just as a toy, but as a professional architecture, engineering, and robotics tool. However, it is merely one of many examples of toys which utilize the most modern manufacturing techniques and materials to make a toy with a huge number of uses.

One of the more venerable building toys are log-style building toys the most well-known of which is Lincoln Logs™ which are constructed of wood. While plastic pieces have, on occasion, been provided, Lincoln Logs™ which are designed for the building of toy log cabins and similar westward expansion themed buildings are now, and have for most of their existence, been made of wood. Log-style building toys are well established and in many respects a "classic" toy. Lincoln Logs™ have been inducted into the toy hall of fame and have been on sale for almost a century.

Log-style building toys provide for certain benefits over other types of building toys. Because they are commonly made of wood, they provide for a different, and often desirable, texture, heft, and structure compared to most other building toys which are made from plastic. This can be beneficial to expose children to different experiences and allow them to work with different materials. They also provide for much easier construction of certain types of period structures, and provide for a structure with resultant surface depths and transitions.

At the same time, wood is relatively limited in its connection ability. Most modern building toys which provide for interconnection between parts generally rely on the slight giveability and resilience of plastics to provide for a strong interconnection. Basically, these toys "snap" together by causing the plastic to slightly deform and reform as the pieces connect. This is a feature that wood generally does not have. Because of that, log-style building toys have traditionally had a very strong limitation in the types of things they can construct. Specifically, they can only interconnect by connecting one cutout to another at right angles forcing than to make square structures. This arrangement is illustrated in U.S. Pat. No. 1,351,086, the entire disclosure of which is herein incorporated by reference, that indicates that structures are assembled by interconnecting corresponding notches of transversely laid logs.

The problem with this arrangement, it that it essentially allows only for interconnection at right angles and at corners. While the patent contemplates the use of very short logs to essentially "fill" in notches where there is no structural transverse piece, the construction is very limited. This can be frustrating to children where a set of log-style building toys can really only be used to build a relatively specific building or set of buildings, and those buildings often lack the desired features that a child wants (such as a window in a particular position). Most children expect building toys to have a wide degree of flexibility Those that lack flexibility are often rapidly discarded.

Log-style building toys also have problems in that the structures they build necessarily have gaps that would not exist in an actual building of log construction and lack certain important components. Roofs are generally simply laid on and often collapse with just minimal play. Many structures formed of these building toys are relatively unstable, and collapse if played with as toy structures. Further, floors and interior details are generally very complicated or impossible to build. Instead, interior details are usually provided more in the form of doll house furniture as preconstructed elements.

While the lack of flexibility can be frustrating for children, it has also resulted in log-style building toys being of little use for adult entertainment. Many Older adults, particularly those with degenerative neurological diseases such as Alzheimer's disease, can be entertained, and interacted with, through play because it is such a fundamental human action. Further, many older adults are comforted by textures of toys that are more akin to what they grew up with, not more modern plastics. One would think, therefore, that log-style building toys would be a valuable toy for use with adults. However, the lack of flexibility of existing log-style building toys can often make it too simple of a toy for these types of adults who have no interest in building in accordance with a plan or picture, but wish to express themselves creatively.

SUMMARY

The following is a summary of the invention in order to provide a basic understanding of some aspects of the invention. This summary is not intended to identify key or critical elements of the invention or to delineate the scope of the invention. The sole purpose of this section is to present some concepts of the invention in a simplified form as a prelude to the more detailed description that is presented later.

Because of these and other problems in the art, described herein among other things are a building toy and a method of building with it. The toy is designed to be constructed of a rigid and generally non-deformable material such as, but not limited to, wood and particularly hardwood, and is constructed in the fashion of a log-style building toy. The toy utilizes interconnecting notches in its construction, but provides for a variety of specialized pieces which allow for interconnection of parts where there is one notch but not another, as well as the ability to build roofs, floors, and specialty structures such as fireplaces through the use of specialized components. Further, the use of more strongly connecting components allows for stronger structures to be built.

Described herein, among other things, is a log-style building toy comprising: at least two basic logs, each of the basic logs being generally in the form of an elongated parallelepiped with two opposing ends and four sides giving it a width, height, and length; the basic log including at least four notches arranged therein, the four notches being arranged as two pairs of notches with each of the pairs of notches arranged toward the opposing ends, each of the notches in each pair of notches being arranged on opposing sides of the basic log; and at least one special log, the special log being generally in the form of an elongated parallelepiped with two opposing ends and four sides; the basic log including at least two notches arranged therein, the two notches being arranged as a pair with each of the notches in the pair being arranged on opposing sides of the special log; wherein, all of the notches in both the basic logs and the special log are configured to extend a depth of one quarter of the height of the basic log into the log into which they are formed; wherein, the special log has a height which is generally three-quarters (¾) the height of the basic log; and wherein the notches on different logs are designed to interlock with each other when the notches are aligned and the logs with the aligned notches are placed generally perpendicular to each other.

In an embodiment of the building toy, the building toy is constructed from hardwood.

In an embodiment of the building toy, the two basic logs are of different length.

In an embodiment, the building toy further comprises at least one additional basic log with a length different from the at least two basic logs.

In an embodiment, the building toy further comprising at least two gables and a plurality of roof slats having two opposing ends and four sides, each of the roof slats including a flange on one of the sides.

In an embodiment of the building toy, the flanges are positioned to extend from a major surface of the roof slat creating a co-planar surface with the major surface.

In an embodiment, the building toy, further comprises a gable support which slides into grooves on a first surface of each of the gables to inhibit two opposing gables from moving toward each other.

In an embodiment, the building toy further comprises at least four roof rafters and two band boards, where the roof rafters can be positioned as two opposing pairs on the band boards to form roof gables.

In an embodiment of the building toy, each of the band boards is of the same size and shape as the at least two basic logs, but includes only two notches on a single side thereof.

In an embodiment of the building toy, the band board includes an elongated channel running the length of a side opposing the single side with the notches therein.

In an embodiment of the building toy, the channel creates two opposing rails to either of which the roof rafters can attach via a groove in the roof rafters.

In an embodiment of the building toy, the channel extends to a second side of the band board to create a single rail to which the roof rafters can attach via a groove in the roof rafters.

In an embodiment, the building toy further comprises a floor support log generally in the form of an elongated parallelepiped with two opposing ends and four sides giving it a width, height, and length; the floor support log including at least four notches arranged therein, the four notches being arranged as two pairs of notches with each of the pairs of notches arranged toward the opposing ends, each of the notches in each pair of notches being arranged on opposing sides of the floor support log; and the floor support log including an elongated channel between both the ends arranged in a side which does not include any notches.

In an embodiment, the building toy further comprises: a chimney transition piece; and a chimney block connectable to the chimney transition piece.

In an embodiment of the building toy, both the chimney transition piece and the chimney block include holes.

In an embodiment, the building toy further comprises a dowel sized and shaped to fit into the holes, the dowel serving to connect the chimney block to the chimney transition piece.

In an embodiment, the building toy further comprises a bay window log, the bay window log having a large notch therein which is the length of two notches.

There is also described herein a log-style building toy comprising: at least two basic logs, each of said basic logs being generally in the form of an elongated parallelepiped with two opposing ends and four sides giving it a width, height, and length; the basic log including at least four notches arranged therein, said four notches being arranged as two pairs of notches with each of said pairs of notches arranged toward said opposing ends, each of the notches in each pair of notches being arranged on opposing sides of said basic log; and at least four roof rafters and two band boards, where said roof rafters can be positioned as two opposing pairs on said band boards to form roof gables; wherein, of said notches in said basic logs are configured to extend a depth of one quarter of the height of the basic log into the basic log into which they are formed; wherein said notches are designed to interlock with each other when said notches are aligned and said logs with said aligned notches are placed generally perpendicular to each other; and wherein each of said two opposing pairs of roof rafters includes a slot towards a peak when formed into said roof gables, said slot accommodating a basic log at said pair of notches.

In an embodiment of the building toy, at least one of said at least four roof rafters is a dormer rafter having an elongated slot therein, said elongated slot being sized and shaped to mate with a dormer log having a tongue on one end thereof.

In an embodiment of the building toy, at least one of said at least four roof rafters is a hip rafter, said hip rafter intersecting at least one of said band boards at a non-perpendicular angle.

BRIEF DESCRIPTION OF THE DRAWINGS

FIG. 1A shows a basic log, FIG. 1B shows a half log, and FIG. 1C shows a special log.

FIG. 23A shows a band board pin connector log, FIG. 23B shows a band board closed corner log, and FIG. 23C shows a hole connector log for use with the logs of FIGS. 23A and 23B.

FIG. 32A shows an inside view, FIG. 32B shows an outside view, FIG. 32C shows a bottom view, and FIG. 32D shows a top view.

DESCRIPTION OF THE PREFERRED EMBODIMENT(S)

Described herein a building toy which is intended for the construction of dwelling structures of the types commonly used by humans. The structure is designed to simulate the construction of log homes or similar structures which are constructed from long single pieces of wood as opposed to more modern constructions with wooden frames and slat siding and drywall covering. However, the resulting structure will generally have the appearance not of a true log home (which utilizes generally cylindrical logs in its construction) but of the more rectangular siding structure common in wood or vinyl sided structures. However, the exact appearance is by no means required.

Figure 1A:
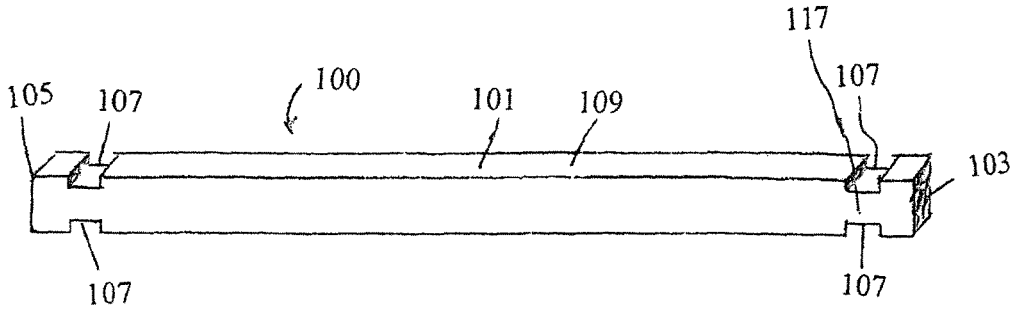
FIGS. 1A-1C show three basic log components of an embodiment of the building toy. Specifically.

The building toy is composed primarily of elongated parallelepipeds often with rounded corners to provide for better feel. However, generally cylindrical parts can be used in another embodiment. An embodiment of a general structure of the core building component of such a toy is shown in FIG. 1A. Many of the pieces of the toy will generally be referred to herein as "logs" due to their general shape and intended build methodology. Each log will generally be constructed of a relatively rigid and non-deformable material such as but not limited to wood (particularly hardwood), metal, rigid hard plastic, or stone. Non-deformable materials are preferred because the building toy is designed to utilize interlocking notches as the primary component of interconnection. Thus, the toy is not designed to have components deform in order to allow interconnection. Use of a rigid material is preferred not only because deformability is not necessary, but because such materials can provide the logs with greater heft and often a more interesting tactile experience.

FIG. 1A shows a basic log (100). Is comprised of an elongated body (101) of generally parallelepiped shape with four sides and two opposing ends (103) and (105). The shape will generally be defined by the elongate length, as well as a middle dimension height and smallest dimension width, however the relative sizes of the last two dimensions may be reversed in some embodiments. There will generally positioned toward each of the ends (103) and (105) a notch (107). In a basic log (100) there are two notches (107) positioned on opposing sides of the basic log (100) toward both ends (103) and (105). The notches will generally be on the two sides defining the dimension of height. A basic log (100) may also additionally or alternatively include any number of notches (107) within the center portion (109) between the notches (107) shown in FIG. 1A but that is not required as discussed later. Generally basic logs (100) will be provided in a variety of different lengths of the main body. These will often be multiples of lengths of other components so basic logs of 1, 2, 3, 4, 5, or more times the length of any other basic log (100) could be used.

The basic log (100) will also generally be provided in a "spacer" format which is designed to be shorter. A spacer format basic log (100) will generally only have a single notch (107) and the distance between the center of the notch (107) and the end (105) will be equal to the distance from the center of the notch (107) to the end (103). Generally, a notch (107) in the basic log (100) will extend about one-quarter (¼) of the height of the center portion (109) of the basic log (100). Thus, the height of the portion (117) of the basic log (100) between any two opposing notches (107) will generally be about one-half (½) the width of the center portion (109) of the basic log (100). Each notch (107) will generally have a length equal to the width of the log so that a log placed transverse to another with their notches align can be interlocked. The basic log (100) is the core building component of the toy.

Figure 1B:
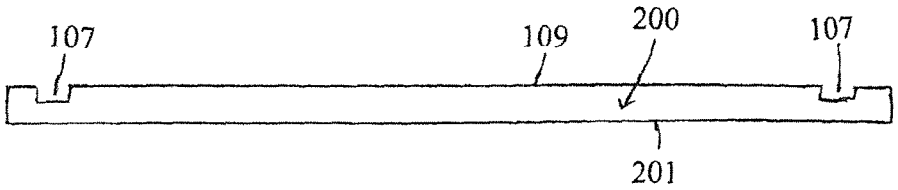

FIG. 1B provides an embodiment of a half log (200). The half log (200) is effectively the same arrangement as a basic log (100) which has been split in half along its length. It will generally only include notches (107) along a single side as shown in FIG. 1B. The half log (200) will generally be used to allow for a flat surface (201) to be provided so as to allow a construction of the toy to rest cleanly on a support structure.

Figure 1C:
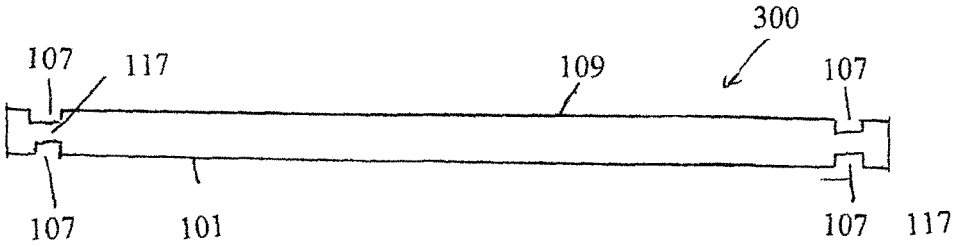

FIG. 1C provides for a special log (300). The special log (300) is designed to act as a part connector. In particular, it is designed to interconnect a notch (107) of any one log to the center portion (109) of another log. The special log (300) will generally be of the same design as the basic log (100), however it's dimensions are different. The special log (300) will have a main body (101) height which is only three quarters (¾) the height of a basic log (100), however, its width is the same as a basic log (100). As with all logs, its length is variable.

Figure 3:
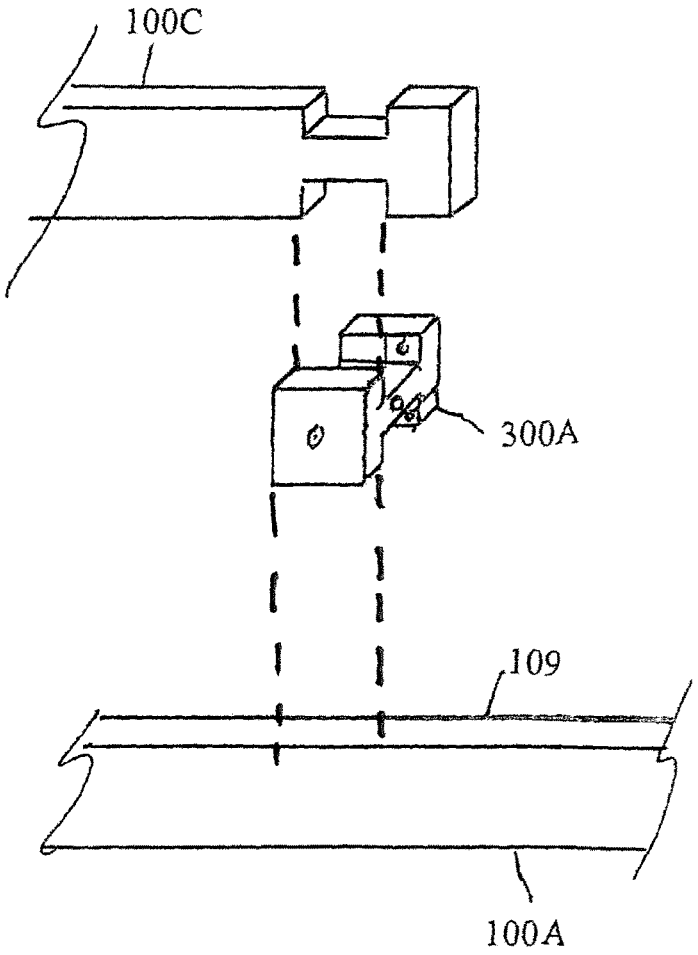
FIG. 3 shows how a specialty connector can be used to connect two logs together where there is only one notch present.

The notches (107) in the special log (300) are cut to the same dimensions as those of the basic log (100). Specifically, they are cut one quarter (¼) the height of the basic log (100) deep. This means the connector portion 117) is precisely one-quarter (¼) the height of the basic log (100) or one half (½) the height of the connector portion (117) of a basic log. While FIG. 1C shows a special log in the same arrangement as that of FIG. 1A, most of the special log (300) components of a toy set will generally be provided in the arrangement of a spacer log with only a single set of opposing notches (107). One such special log (300A) is shown in FIG. 3.

Figure 2:
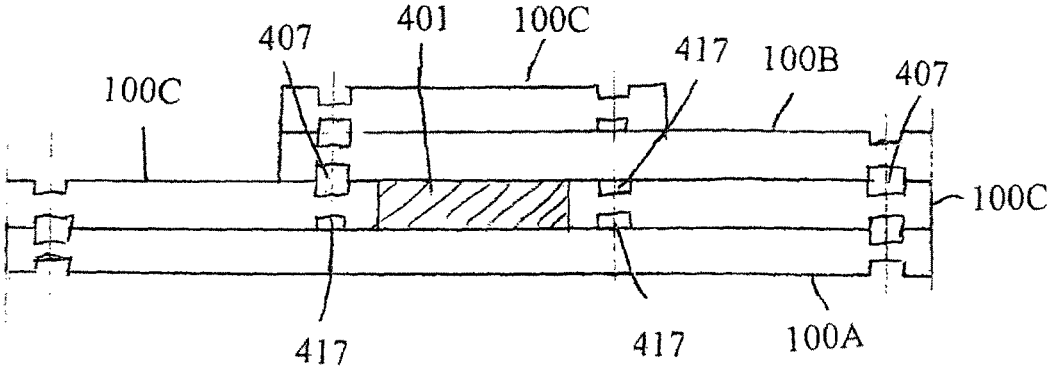
FIG. 2 shows an embodiment of the relative lengths of logs and how their notches will interlay when placed into a wail arrangement.

FIG. 2 shows how the various logs can be used to form a wall. As opposed to prior art building toys which required that logs always meet at notches (107), the present toy has no such requirement. In the arrangement of FIG. 2, three different lengths of basic log (100A), (100B) and (100C) which have no internal notches (107) in the center portions (109) have been arranged in the form of a wall which includes a void (401) which could be used as a window or similar architectural element. As can be seen from the FIG. at some points (407) two notches (107) are aligned while at other points (417) a notch (017) is against the central portion (109) of another log.

In the double notch points (407), a basic log (100) of desired size may be used as is common in prior art designs by simply aligning its notches (107) with the double notch point (407) while transverse to the page of FIG. 2. However, placement of a basic log (100) in a single notch point (417) would produce an unstable attachment. However, the portion (117) of a special log (300) is correctly sized to fit here allowing a connection to be made as shown in FIG. 3. Due to the length of the notch (107) corresponding to the width of the log, the log (100A) can be placed within the notch (107) at its center section (109).

It should be noted that in positions where there is a double notch point (407) above or below a single notch point (417) (as is show at the left internal notch stack in FIG. 2), because the special log (300) has only the total height of a basic log (100), the ends will touch forming a clean connection. The same is also true of two half notches above each other (as is shown in the right internal notch stack in FIG. 2) where the two special logs (300) will also touch creating a clean structure.

It should be apparent from the above that the inclusion of the special log (300) provides for vastly improved flexibility in construction as it eliminates the need for logs to always meet at notches. Thus, it is possible to make basic logs (100) of essentially any length, even if they are not multiples of each other. This allows for there to be a near limitless ability to create voids (401) of different shapes and sizes. As voids (401) are commonly used to represent windows and doors, these can now be positioned virtually anywhere in the walls, and need not be square as use of different lengths of basic logs (100) can create other shapes such as polygons which can appear rounded in certain situations.

While the above provides for vastly more flexibility to the basic log construction and many more options for use of the toy, with that flexibility it can also be desirable to have additional components which allow for the flexibility to carry into additional common components of man-made structures and dwellings.

Figure 4:
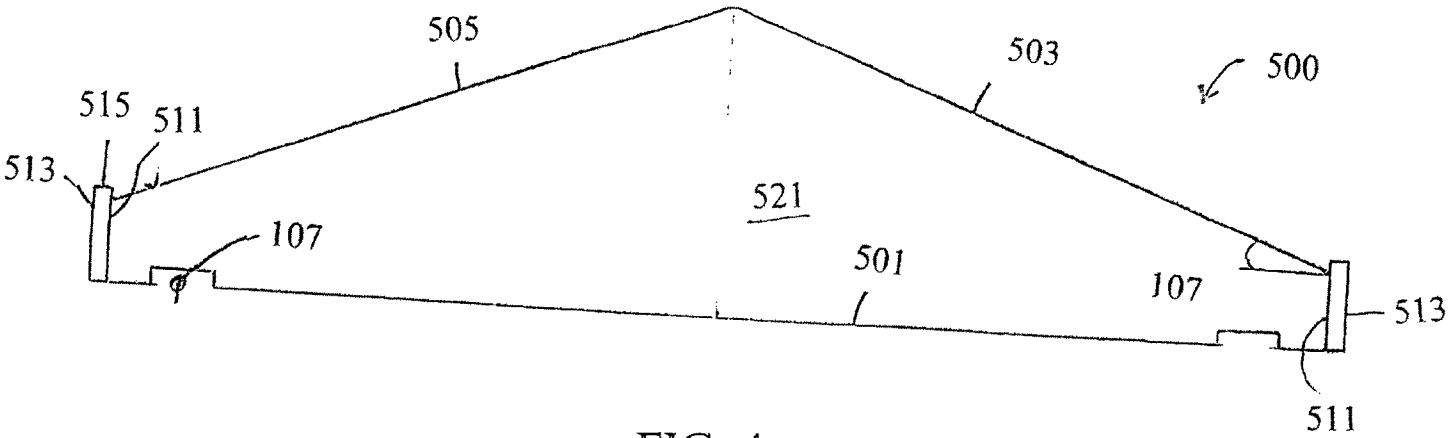
FIG. 4 shows an outside plan view of an embodiment of a fixed length roof gable.
Figure 6:
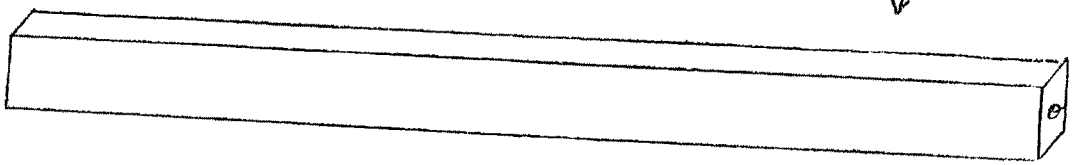
FIG. 6 shows an embodiment of a gable support.
Figure 5:
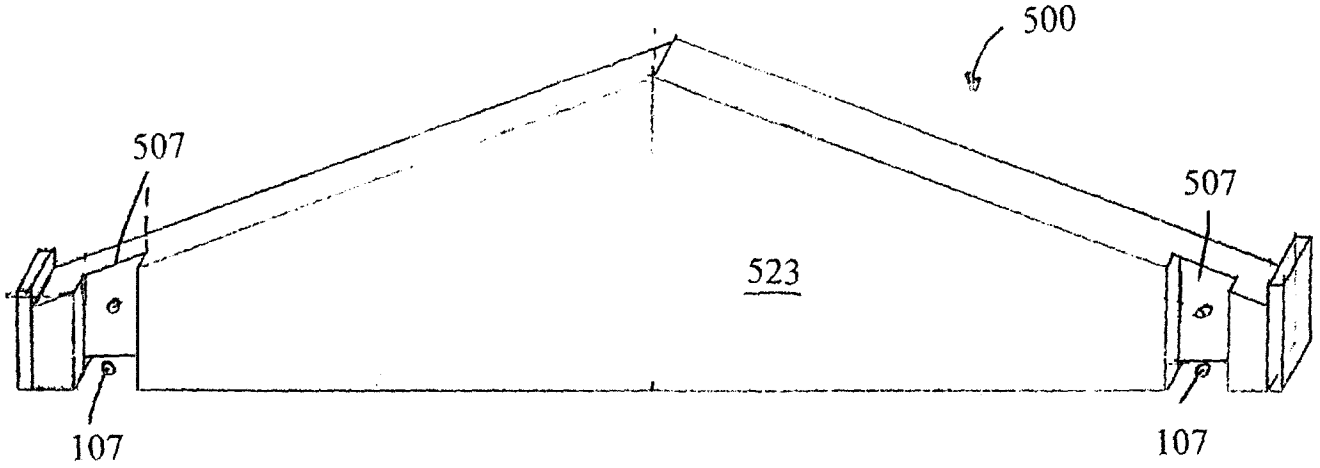
FIG. 5 shows an inside plan view of the gable of FIG. 4.

FIGS. 4 through 7 provide for various views of a fixed length and angle gable (500) for the formation of roofs for the toy structures. The gable (500) generally comprises a roughly triangular structure with blunted corners having a base (501) and two tops (503) and (505). While the gable (500) of the FIGS. is an isosceles triangle, this is by no means required and other shapes can be used. Isosceles triangles, however, are commonly associated with the shapes of roofs making their design particularly appealing. Each gable will generally include two end notches (107) of the same depth as all the other previously discussed pieces on its bottom surface (501). However, as shown in FIG. 5, the gable (500) will also generally include a groove (507) aligned at 90 degrees to the notch (107). This groove (507) is generally of similar depth to the notch (107) and intersects it. The groove (507) serves as a point in which to slide a gable support (600).

Figure 7:
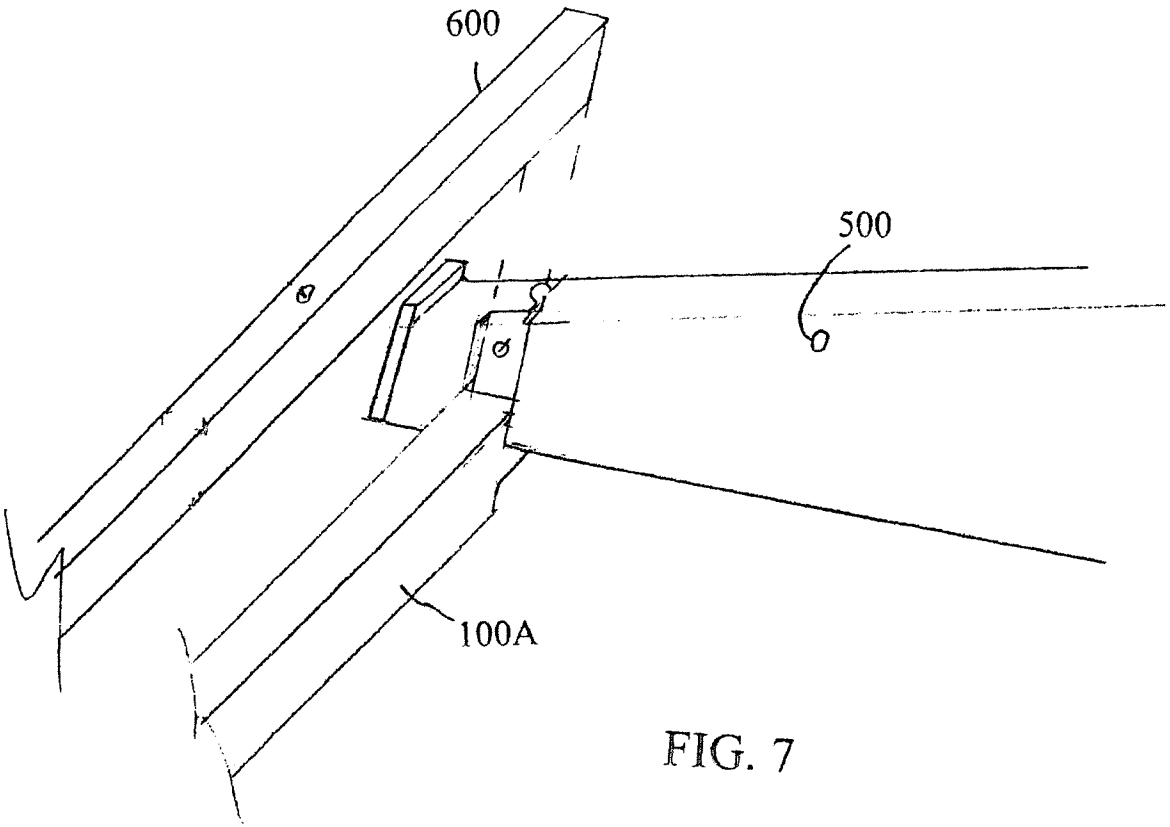
FIG. 7 shows the interconnection of a gable to a gable support to create a roof support.

The gable support (600) is shown in FIG. 5 and generally the same height and width dimensions as a basic log (100) from the set, but includes no notches, and has a length that is around the length of the basic log between the edges of the end notches (107) plus twice the depth of the groove (507). However, the length of the gable support (600) is highly variable and generally can be anything so long as the support interconnects to support the gables (500) such as is shown in FIG. 7. The gable support (600) is generally used to provide an internal surface which makes a wall smooth and continuous under the rafters.

FIG. 7 shows how one of the gables (500) would be connected to form a roof although two gables (500) opposingly positioned would generally be used. The gable (500) will generally be placed with the notch (107) of the gable (500) perpendicularly aligned with a notch (107) of generally a basic log (100A), although any log with a notch can be used. Once the notches (107) are positioned, the gable support (600) is dropped into the groove. It, therefore, supplies a surface resembling the rest of the wall, but it also serves to support the gable (500) upright. It should be apparent that with the notches (107) aligned between the gable (500) and basic log (100A), the outside surface (521) of the gable (500) is pushed against the inside of the basic log's (100A) notch (107). Further, the gable support (600) is against the inside surface of the groove (507).

If two gables (500) are now positioned opposing each other with their inside surfaces (523) facing and at a distance proportional to the selected gable support (600), the gables (500) effectively interlock with each other with the gable supports (600) on both sides, and the insides of the notches (107) of the basic log (100A) to form a fairly rigid structure to support the roof.

Figure 8:
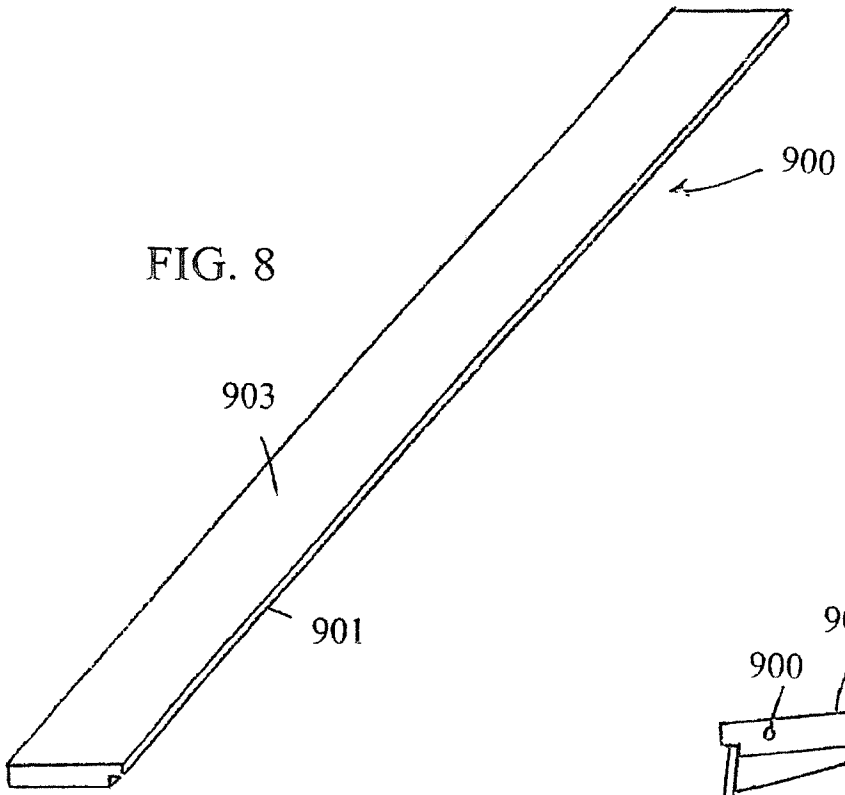
FIG. 8 shows an embodiment of a roof slat.
Figure 9:
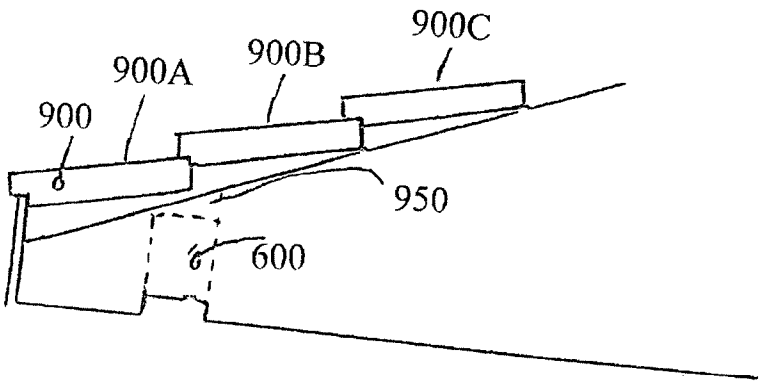
FIG. 9 shows an embodiment of roof slats arranged on the support of FIG. 8 or 14.

FIGS. 8 and 9 illustrate how a roof can be formed using two opposing gables (500). A plurality of roof slats (900) are generally provided with the toy. The roof slats (900) may be of any length, but as with all pieces will generally be of relatively common size based on relative proportions compared to the basic logs (100). Each roof slat (900) comprises a parallelepiped generally with one significantly smaller dimension. In an alternative embodiment, the roof slat (900) may be of a trapezoidal or parallelogram main shape to allow for the slat to have angled ends. This provides for an alternative appearance, but can also allow slats to interact with each other at an angle as will be preferable in a hip roof, two connected roofs, or a dormer as contemplated later. On one of the elongated narrow sides of the slat (900) there is a flange (901) which extends outwardly form the main body (903) of the slat. The flange will generally be about half the width (smallest dimension) of the roof slat and will be arranged to extend from one of the major surfaces to provide a co-planar surface with it.

As is visible in FIGS. 4 and 5, each of the gables (500) does not comprise a true triangle, but instead has the corners where each tops (503) and (505) intersect the base (501) cut off to form an end (511). At each end there is a support piece (513) which is generally aligned with the surfaces of the base (501) and each side (521) and (523). The support piece (513) is, however, generally is slightly taller than the end (511) resulting in their being a small extension (515) above the top (503) and (505).

To form a roof, the roof slats (900) are positioned on the top sides (503) and (505) of the gables as shown in FIG. 9. As can be seen from FIG. 9, each roof slat (900) is arranged so as to extend between the two gables (500). The lowest roof slat (900A) has its flange (901) resting on the top corner of the support piece (513) and therefore slightly raised above the top side (503) or (505) by a portion of the extension. Each consecutive roof slat (900B) and (900C) is positioned on the prior roof slat (900A) and (900B) respectively so that its flange (901) over hangs the back corner of the prior roof slat (900A) or (900B). This partial overlay provides for a more natural looking roof design, and also inhibits the roof slats (900) from sliding down the top surfaces (503) and (505).

It should also be apparent from FIG. 9 how the gable support (600) effectively blocks line of sight under the roof slats (900). With appropriate sizing, the gable support (600) will extend to a point either touching or just below the upward edge of the forward most roof slat (900A), and that point is generally vertically higher than the downward edge of the same slat. Thus, the gap (950), to the extent one exists, is generally hidden from sight by roof slat (900A).

While the gable (500) provides for a solid appearing roof with no obvious gaps and a sturdy construction method, the gable (500) is limited in that it has a large number of fixed dimensions. As the building toy is designed to have a large amount of variability in structure design, it is desirable in an embodiment to have a roof gabling system with increased flexibility compared to that shown in FIGS. 4-7. An embodiment of such a design is provided in FIGS. 10-13.

Figure 10:
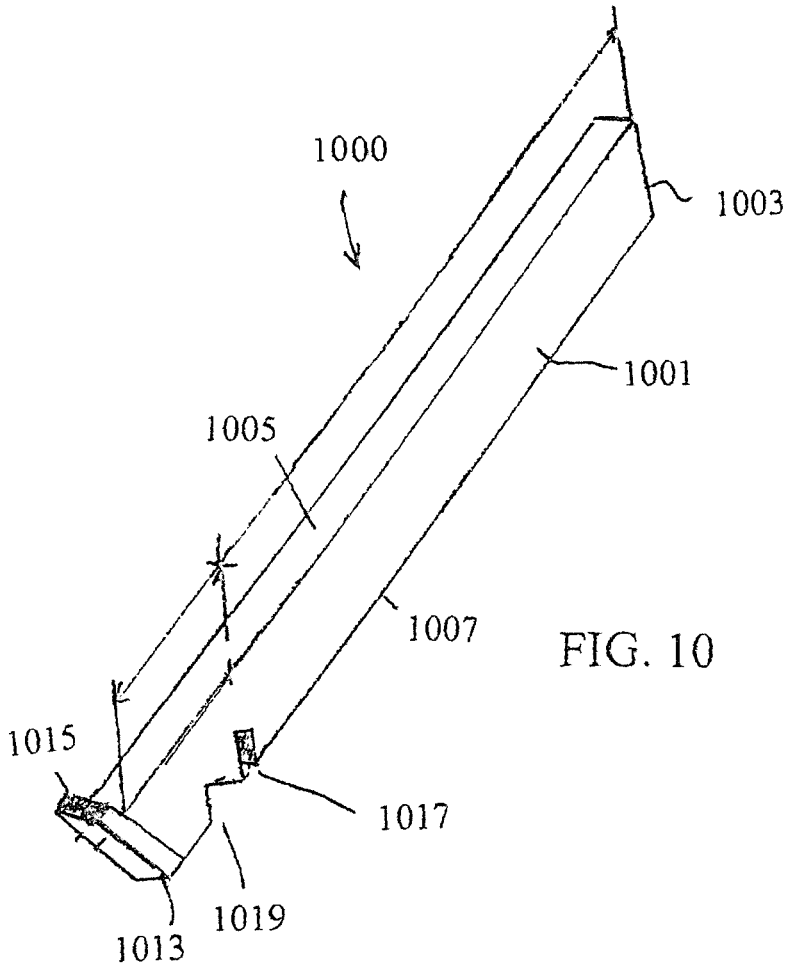
FIG. 10 shows an embodiment of a roof rafter.

FIG. 10 provides for an embodiment of a rafter (1000). The rafter (1000) comprises a generally parallelepiped main body (1001) where the first end (1003) is cut at an angle from the top to the bottom (e.g. the angle is relative to the height). At the second end (1005) there is included a support piece (1013) of design generally similar to support piece (513) of FIG. 4 and which provides an extension (1015) above the top surface (1005) of the rafter. Note that while rafter (1000) does not show a slot (2901) as shown in the rafter (2900) of FIG. 29A, it could include such a structure in an alternative embodiment.

Figure 11:
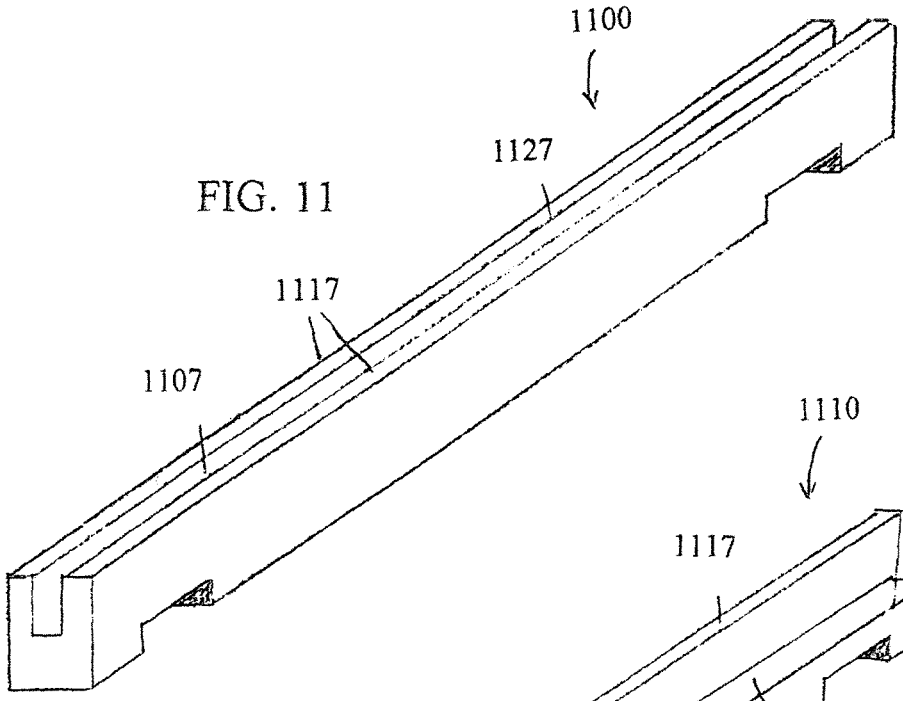
FIG. 11 shows an embodiment of a rafter support or band board.
Figure 12:
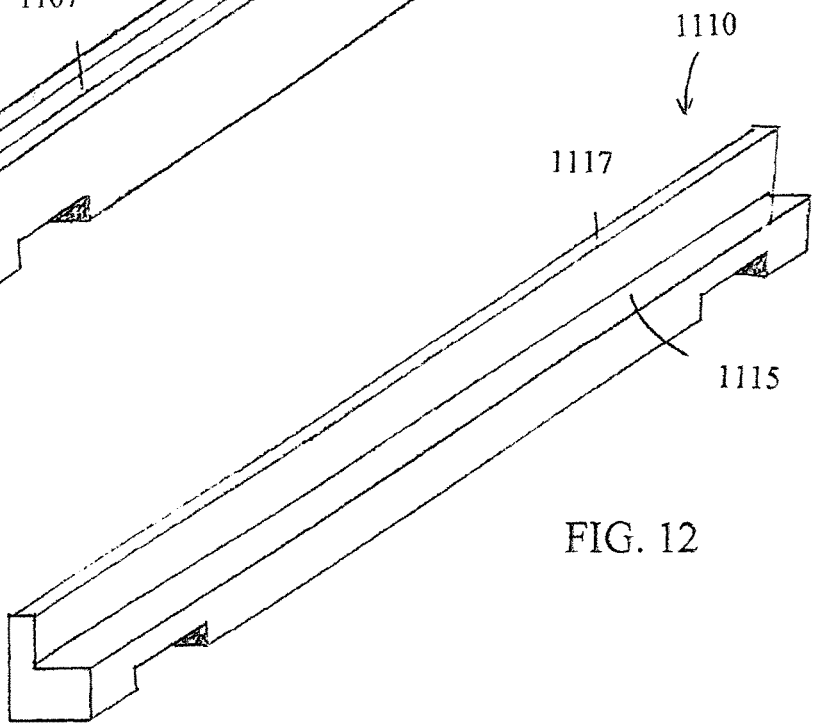
FIG. 12 shows an embodiment of a rafter support which can also support an "attic" floor.

On the bottom surface (1007) of the rafter (1000) there is provided a groove (1017) and a cutout (1019). The groove (1017) is designed to interface with one of the rails (1117) of a roof band hoard (1100) or (1110) as shown in FIGS. 11 and 12 and will generally be cut into the rafter (1000) at an angle corresponding to the angle the first end (1003) is cut to. As such, the groove (1017) is generally sized and shaped to hold a rail (1117) therein. The cut out (1019) is an optional component that is designed to allow for the rafter (1000) to clear the end (105) or (103) of a basic log (100) to which the band board (1100) or (1110) is attached if the rafter is placed directly above the notch (107) of the band board (1100) or (1110). This is illustrated in FIG. 13.

As indicated above, FIGS. 11 and 12 provide for embodiments of band boards (1100) and (1110). The band board (1100) of FIG. 11 is considered a default design and is intended for the purpose of attaching a roof only. The band board (1100) is generally the same dimensions as a basic log (100) but includes notches (1017) on only one side (the bottom) thereof. The side opposing the notches (107) has a channel (1107) running therethrough, the entire length of the band board (1100) which creates two flanges or rails (1117) on the opposing sides thereof. Generally the channel (1107) and the rails (1117) are all of the same width (one third (⅓) that of the band board (1100)) and the channel has a depth of one half (½) the height of the band board (1100), but that is by no means required.

The band board (1110) of FIG. 12 is a slight modification of FIG. 11. The band board (1110) is designed to be used where there is to be construction of an attic floor or where an easier to interact with rail (1117) is preferred. The band board (1110) of FIG. 12 is generally identical to the band board (1100) of FIG. 11, however one of the rails (1117) is removed so that the base of the channel (1107) smoothly transitions to the side of the band board (1110) in a floor support surface (1115). This give the band board (1110) a generally "L"-shaped cross sectional structure.

Figure 13:
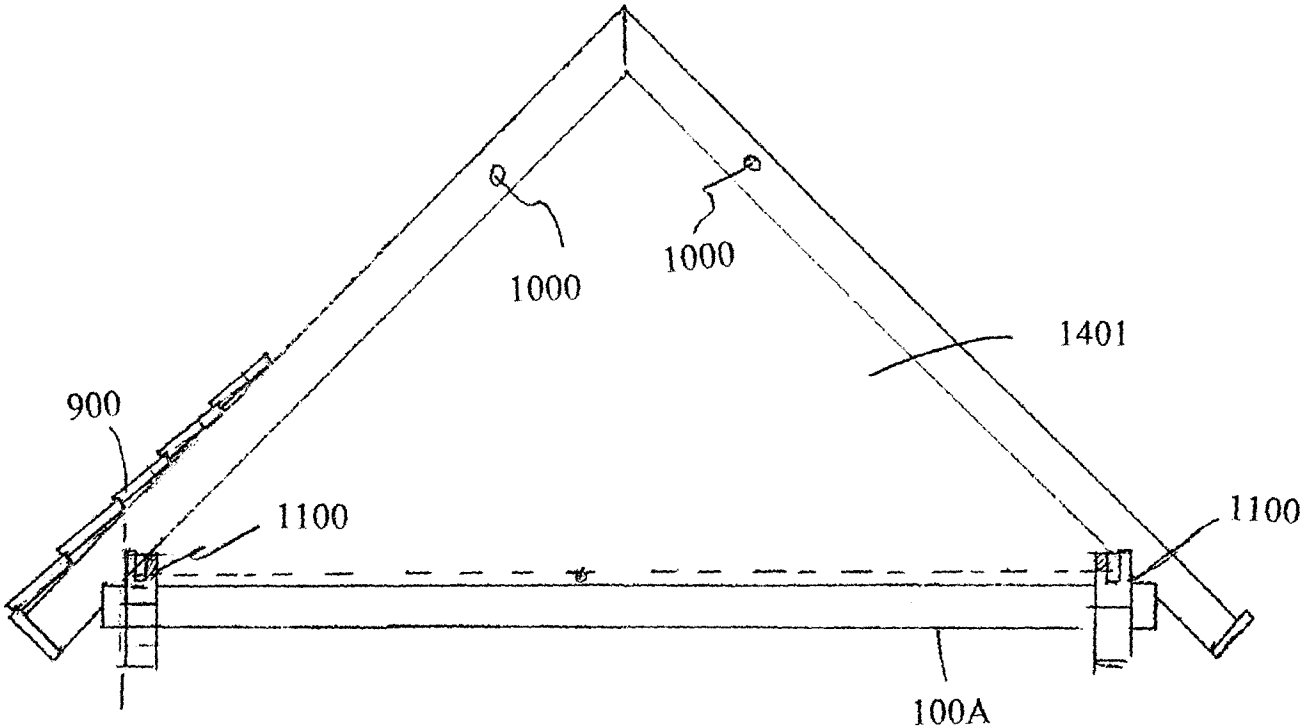
FIG. 13 shows a roof support assembled from the rafters of FIG. 10 and the rafter supports of FIGS. 12 or 13.

FIG. 13 shows how to form a roof using the rafters and band boards of FIGS. 10-12. In FIG. 13, the band boards (1100) or (1110) are positioned transverse the highest basic logs (100) in the structure on two opposing sides. Four rafters (1000) are then used with two opposed length-wise at each side of the structure. The grooves (1017) are posited to hold the outermost rails (1117) of the two band boards (1100) or (1110). The angle ends (1003) of the two opposing rafters (1000) meet to form the roofline. Roof slats (900) are then positioned on the two sets of opposing rafter (1000) pairs in the same manner as when using gables (500).

If band boards (1110) are being used and a floor is desired, floor pieces may be positioned to rest on the floor support surfaces (1115) on the opposing sides. In an embodiment, the floor pieces may be large thin components. In another embodiment, floors are made by interlocking the flanges of two roof slats (900) with each other with a first slat (900) one way over and the other reverse. This forms a flat slab of generally double height. These "double-high" roof slat arrangements can then be arranged side by side to form a smooth floor. It should be noted that this arrangement of roof slats (900) can also be used to form flat roofs whether angled on a gable (500) or rafters (900) or simply across the top of a basic log (100) structure.

One advantage of using the roof band board (1100) in the roof support is that since its width is the same as a basic board, the upper surface (1127) formed of the tops of the two rails can be used to support two special logs (300) and a basic log (100) thereon at any position. This allows for the building of wall structure through the roof such as to build an interconnected tower, a specialized dormer window structure, a chimney, or a smokestack. In such a construction, additional sets of rafters (1000) may be used to make sure that all roof slats (900) are correctly supported on, at least, both their ends.

Figure 23A:
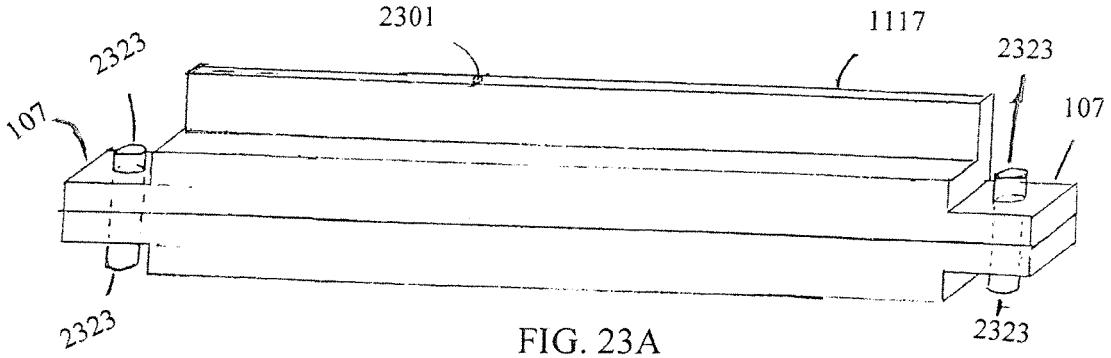
FIGS. 23A, 23B, and 23C show embodiments of rafter supports or band board logs which utilize a closed corner.
Figure 23B:
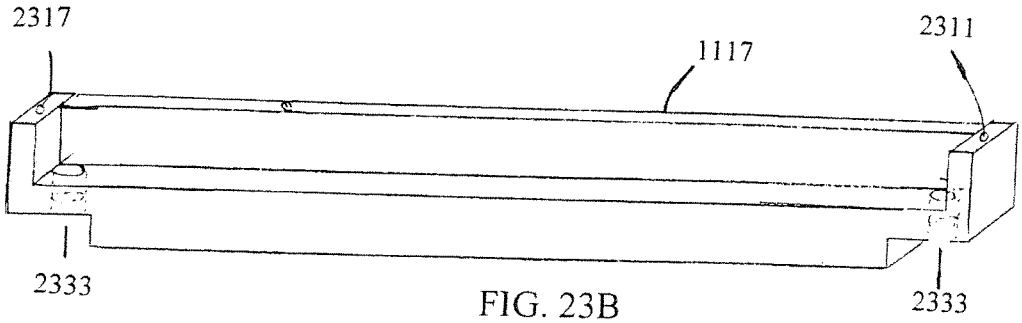
Figure 23C:
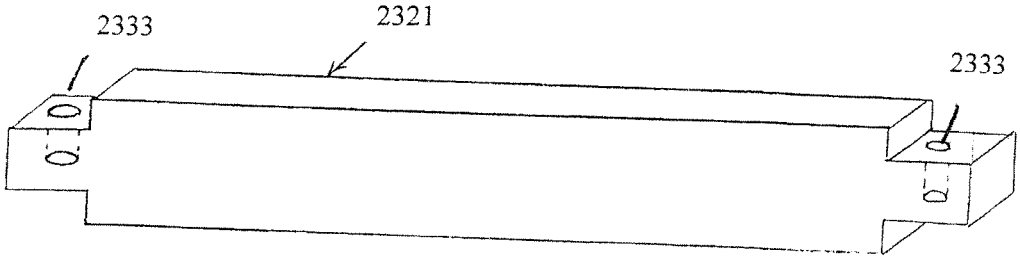
Figure 24:
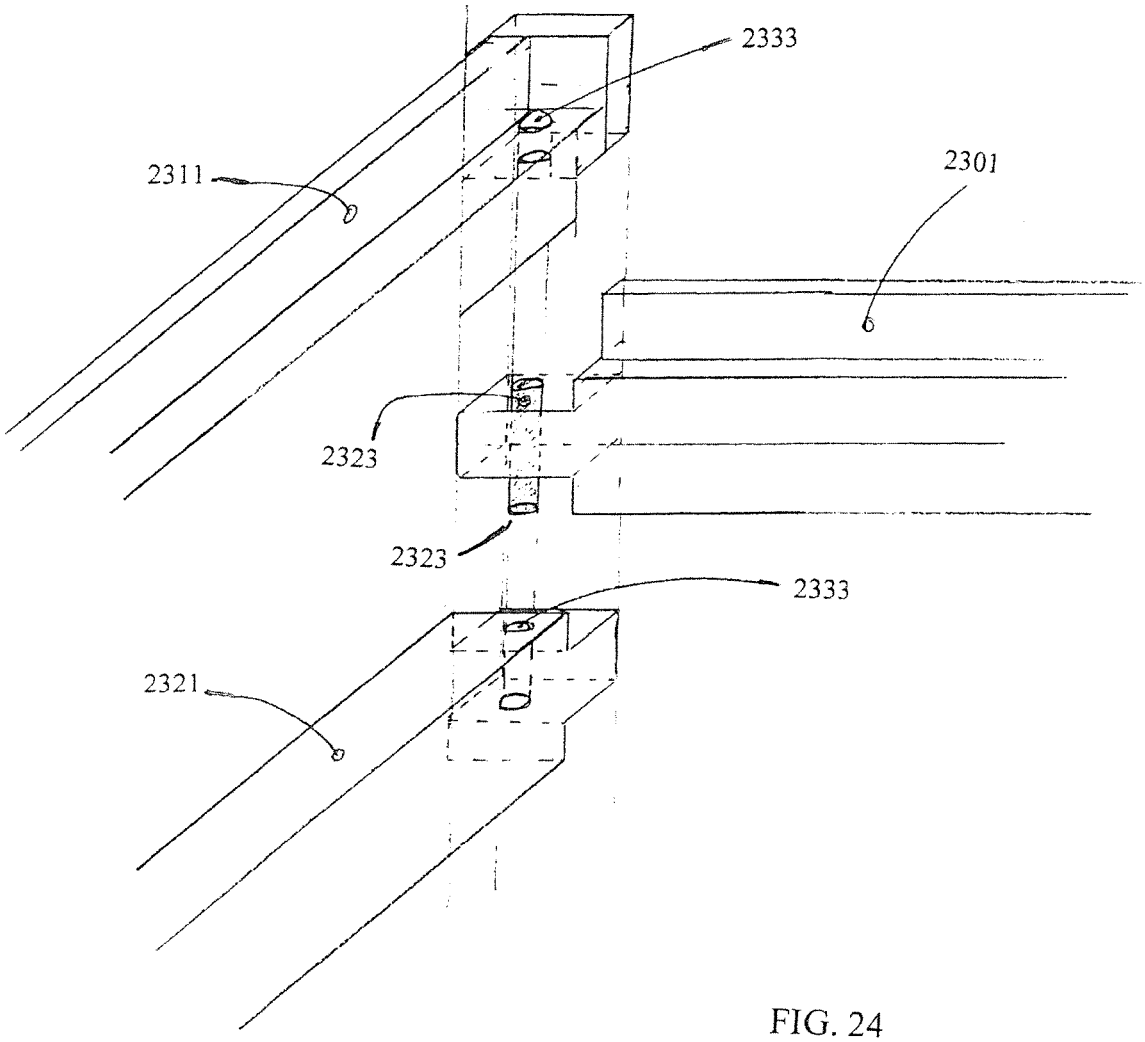
FIG. 24 shows in embodiment of how to form a closed corner with a closed rail from the band board logs shown in FIGS. 23A-23C.

While not indicated in FIG. 13, the rafters (100) of FIG. 11 do produce an open sided roof. In some embodiments, this can be useful to allow access to the attic floor or interior of the structure for play. In an alternative embodiment, the rafters (1000) may be modified to be in the shape of right triangles to fill in the gap (1401) or a fill piece may be provided which may interact with the rafters (1000) to fill the gap (1401). Alternatively a basic log (100) may be positioned on the uppermost surfaces of each of the upper most basic logs (100) of the structure (those which the hand boards (1100) or (1110) are transverse to and internotched with) with special logs (300). Basic logs (100) of different lengths can then be used to fill the hole (1401) including making structures such as gable windows. If dormer rafters (3000) are used instead of rafters (1000) and the dormer rafters (3000) are slotted on both sides (e.g. top and bottom), dormer logs (3300)and/or dormer starters (3200) can also be used to fill the hole (1401), FIGS. 23A, 23B, and 23C show rafter support and band board (2301), (2311), and (2321) pieces which utilize a closed corner. As opposed to the band board (1100) and (1110) of FIGS. 11 and 12, which are designed to have the rails (1117) simply run along two opposing parallel sides of the structure and form a two sided roof as contemplated in FIG. 13, the band boards (2301), (2311), and (2321) provide a corner where the rail (1117) extends around the corner so as to be en all four sides of the structure. The embodiments of FIGS. 23A-23C, are connected as shown in FIG. 24. As can be seen in FIG. 24, the band hoard (2301), (2311), and (2321) arc connected by having a pin (2323) and hole (2333) arrangement where the pin (2323) extends either upward or downward from within the trough (107) and connects with an opposing hole (2333) in a trough (107) in a mating piece. In the band boards (2301), (2311) and (2321), there are no ends (105) or (103) extending beyond the trough (107), thus the log does not extend beyond the corner. While in alternative embodiments, ends (105) and (103) may be provided to give the resultant structure a different look, it is generally preferred that they are not present as it provides a closed corner where components can freely be positioned at and around the corner portion (2317) or the rail (1117). The use of a closed corner as contemplated with these components allows for the extending ends (105) and (103) to be eliminated and for the formation of a generally flat corner. This can allow for other components to be positioned adjacent the two adjacent wall surfaces to make building outward from the wall surface easier. The use of a closed corner is, thus, contemplated below for use with porches, L-shaped and similarly angled buildings, and for certain kinds of hip roofs.

As can be best seen in FIG. 24, the band board (2321) will generally be placed on top of the structure connecting to basic logs (100) or any other type of log in the standard fashion. Band board (2301) will then generally be connected to the band board (2321) at the interfacing notches (107) placing the downward facing pin (2323) of band board (2301) into the hole (2333) in band board (2321). This connection is generally at a 90-degree angle. Band board (2311) is then generally connected above the other two components with the hole (2333) in the band board (2311) going over the upward facing pin (2323) of the band board (2301). The band board (2311) is generally parallel to the band board (2321) and thus perpendicular to the band board (2301). As should be apparent from FIGS. 23A, 23B, 23C, and 24, this creates a rail from rail components (1117) and (2317) that generally goes all the way around the corner and there are no extending ends (103) and (105) forming a closed corner.

The closed corner is valuable if the structure of the roof is desired to extend over the corner. This can be true if the roof is designed to extend between two structures, on an L-shaped structure, or if a hip roof is being used where the roof will extend around the corner in a smooth fashion. In order to create the closed corner, the components utilize a pin and hole construction as the slots are open on one side and while a pin (2323) and hole (2333) structure is not strictly necessary, it can provide improved strength. The pin (2323) and hole (2333) structure of the band boards (2301), (2311), and (2321) are echoed in the pin logs (3600) and hole logs (3800) contemplated in FIG. 36. These structure are all designed to construct a closed corner with no extending ends, while still maintaining structural strength by providing an additional form of interconnection instead of just friction from interacting troughs (107). It should be recognized that a log with a hole structure and no end can also be freely positioned into any pair of adjacent troughs (107) to allow for a horizontal extension from any surface. The hole is simple covered by the adjacent troughs (107) of the assembled structural surface.

Figure 25:
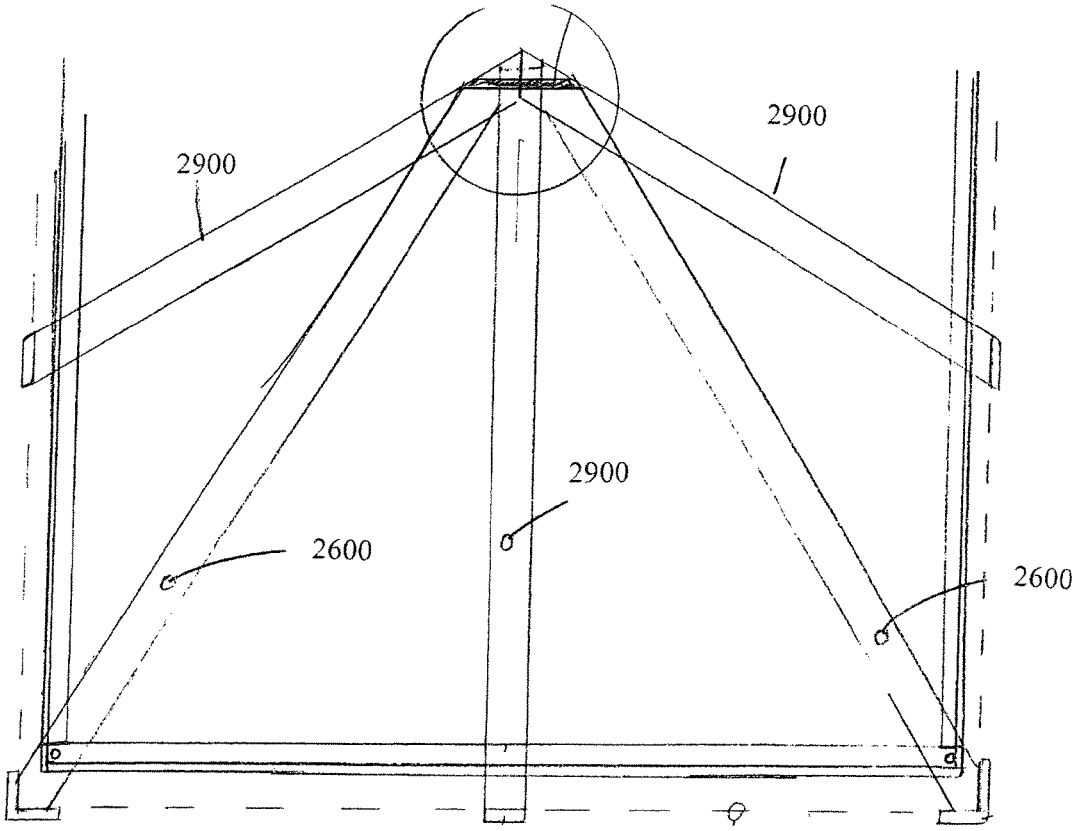
FIG. 25 shows a general overview of an embodiment of a hip roof structure.

FIG. 25 shows how a hip roof can be formed utilizing the closed corner of FIG. 24 to support the hip roof. The hip roof allows for a smooth corner and bending of a roof around the top of the structure. The hip roof structure utilizes hip rafters (2600) and interlocking rafters (2900). In forming the hip roofs the main roof will generally be formed as contemplated in FIG. 13 and will utilize the standard roof rafters (1000) in the middle of the band boards (not shown in FIG. 25). The last pair of rafters as shown in FIG. 25 will generally be interlocking rafters (2900). Alternatively, all the rafters used in the roof may be interlocking rafters (290(i) and standard rafters (1000) need not be used. Note that the hip rafters (2600) used in a hip roof may be of slightly different dimensions to each other (e.g. the central rafter may be shorter) to provide for certain aesthetics in the hip roof, but this is not strictly required.

Figure 26:
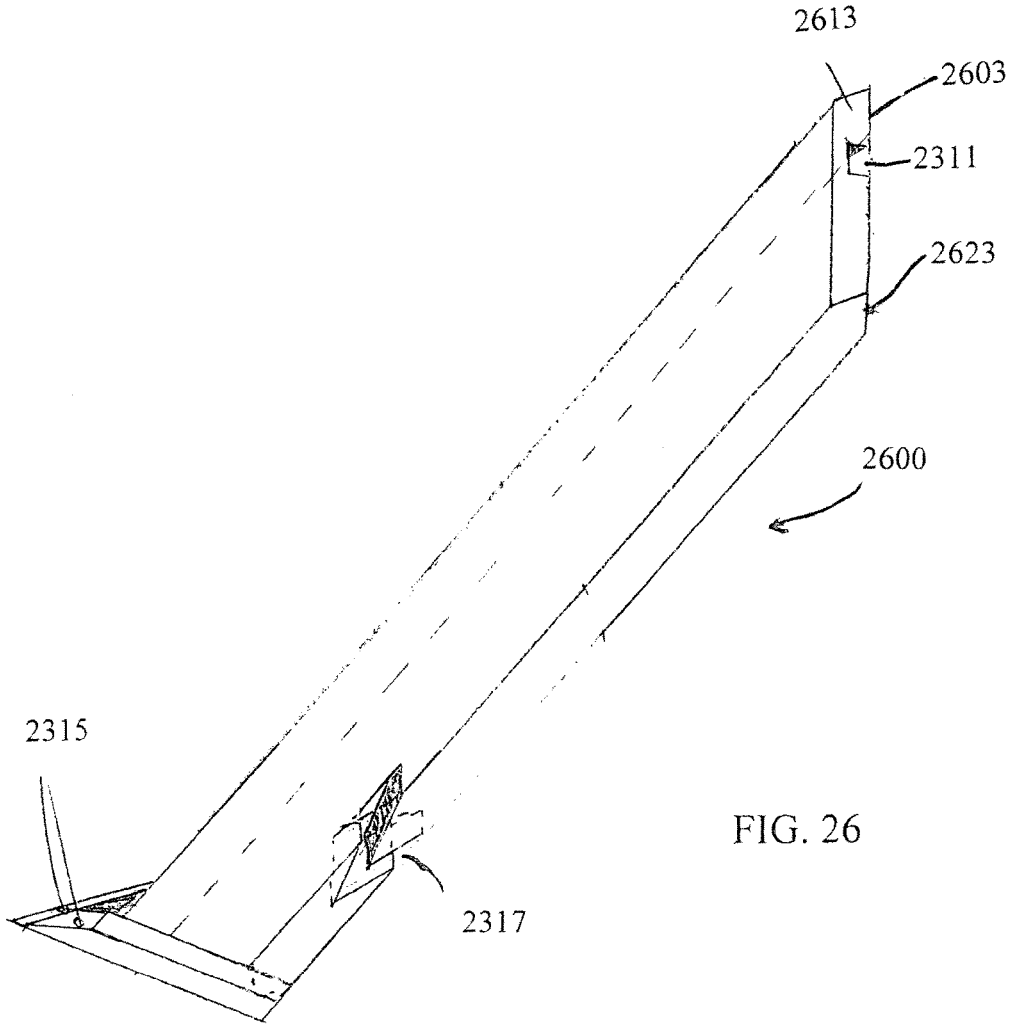
FIG. 26 shows an embodiment of a hip rafter log.

FIG. 26 shows a hip rafter piece (2600) which is designed to provide for the corner of a hip roof The hip rafter piece (2600) includes a slot (2311) which is designed to allow for connection with a connector (2921) within the interlocking rafters (2900) as shown in FIG. 29. The hip rafter (2600) is generally of similar design to the standard rafter (1000).

However, the hip rafter (2600) is designed to connect to a rail corner and at an angle to other rafters as shown in FIG. 25. Thus, the first end (2603) is cut with two angled faces (2613) and (2623) so that it can sit at an angle with the sides of other rafters (1000) in either position as shown in FIG. 25. Similarly, the extension (2315) also provides two angled faces to provide for a corner of roof slats (900) to be positioned. The cutout (2317) is also provided with an internal angle to allow it to position on the corner of the rail (1117) and (2317).

Figure 27:
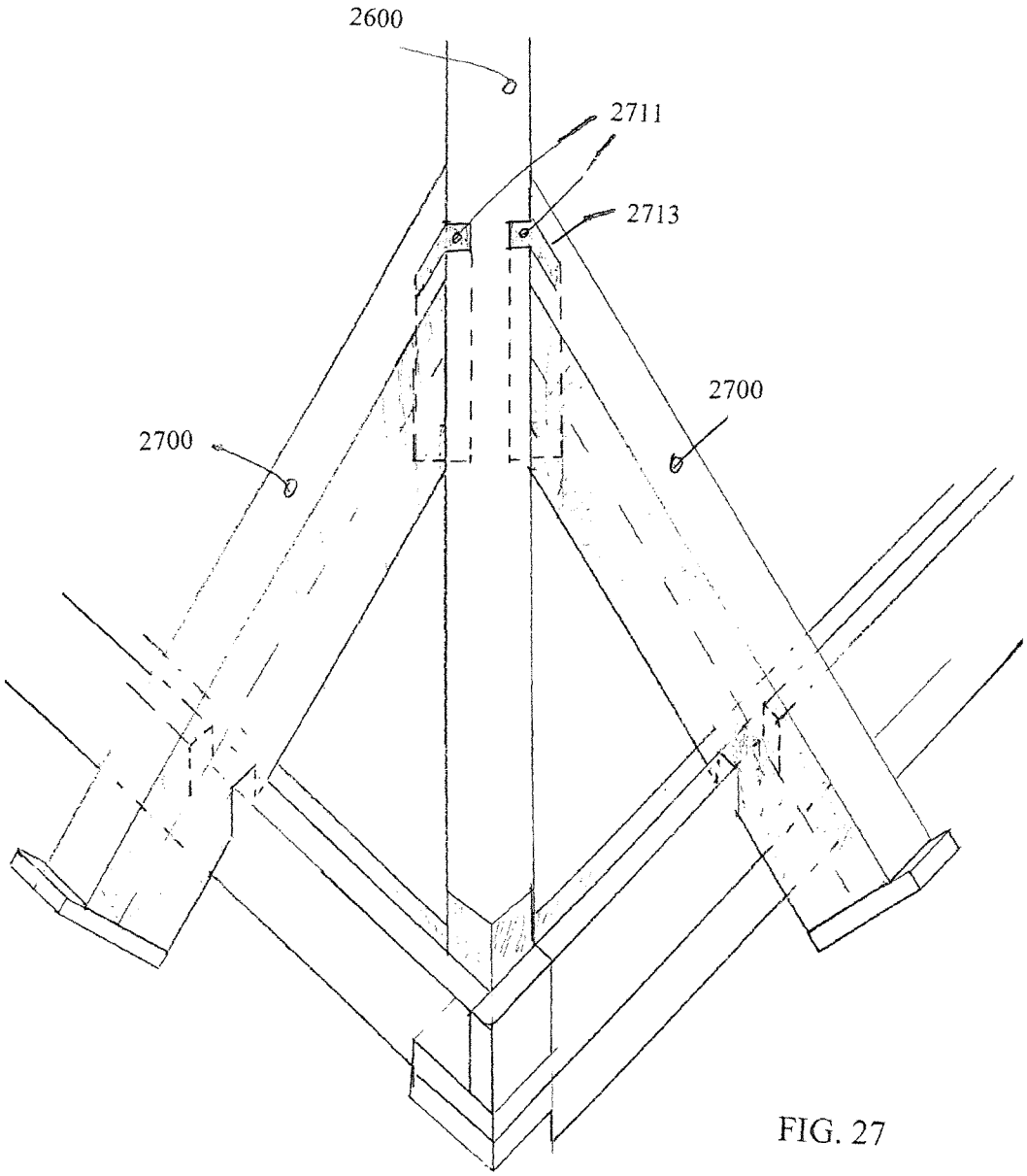
FIG. 27 shows an embodiment of a hip rafter log with splines.

It should be noted that in an alternative embodiment of the hip rafter (2600), extension (2315) is actually partially or totally removed (having either one of the two faces of FIG. 26 or neither instead of both) to allow for the roof to extend over the hip rafter (2600). This, for example, will allow for a roof to be created for a structure with an "I," shape where the hip roof forms a corner of the building (the outer corner of the L) on one side, but needs to extend beyond the corner (and over the leg of the L) on the other. This structure of hip rafter (2600) is shown in FIG. 27. The hip rafter (2600) in FIG. 27 has no extensions (2315).

To provide for improved strength of a hip rafter (2600), the hip rafter (2600) may be provided with supporting splines (2700). This is shown in FIG. 27 which provides the hip rafter (2600) with two splines (2700). The splines (2700) are effectively small rafters that connects to the sides of the hip rafter (2600) at a midpoint along its body. The connection will commonly use sonic form of tongue (2701) in groove (2711) connection to best distribute the force of the rafters (2600) and (2700) against each other. Splines (2700) can be particularly desirable if a roof is to extend beyond the structure the hip rafter (2600) is part of as they can provide for additional support for the slats (900).

Figure 29A:
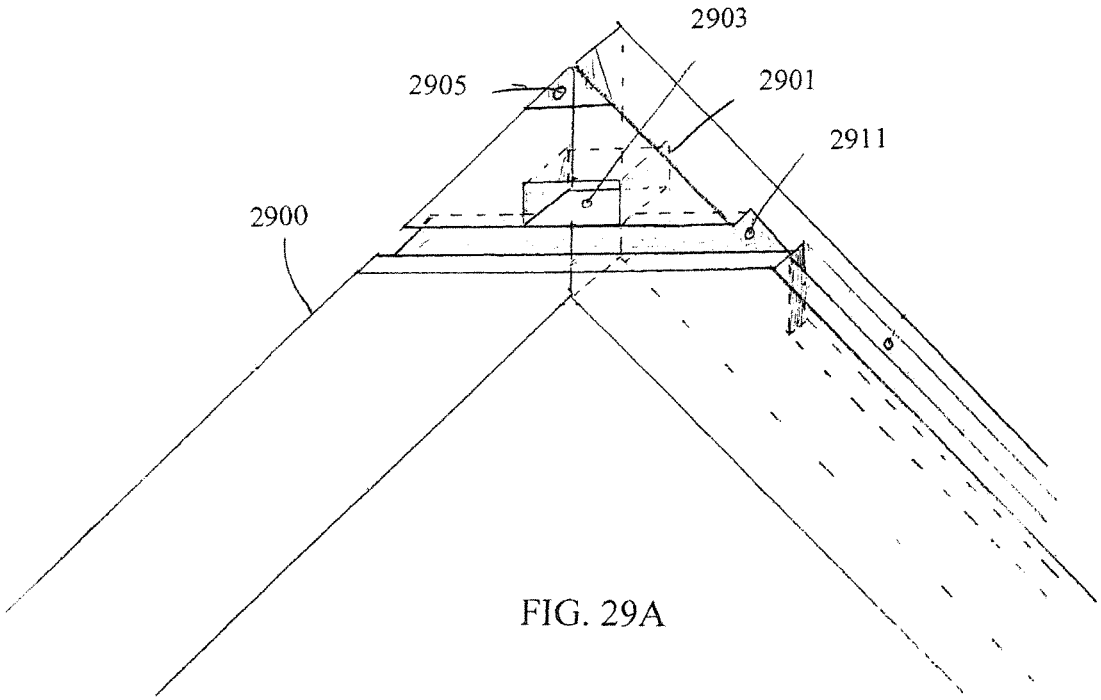
FIG. 29A shows an embodiment of a hip gable formed from two interlocking rafters and FIG. 29B shows a board for allowing the interlocking rafters to connect to hip rafters to form a hip roof.

FIG. 29A shows an interlocking rafter (2900) which can be used to replace the basic rafter (1000) when a hip roof is desired, or even more generally. The interlocking rafter (2900) provides for additional functionality as it provides for an end slot (2901) which together with an opposing rafter (2900) will provide an opening (2903) through the rafter structure. This opening is preferably sized and shaped so as to allow for a hoard to be positioned therein. While this board may be a specialty component the opening (2903) is actually preferably sized and shaped to that a half log (200) or even a specialty log (300) may be positioned in the opening. Generally, with the opening (2903) interacting with the troughs (107) of the half log (200) or special log (300), but this is not required. The half log (200) or special log (300) in this use, will provide for substantially increased strength to the roof and eliminate the need for a specialty piece.

Figure 29B:
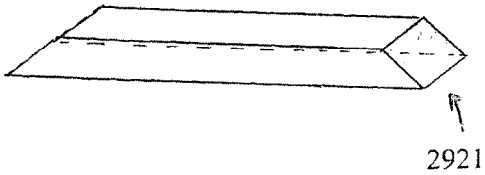
Figure 39:
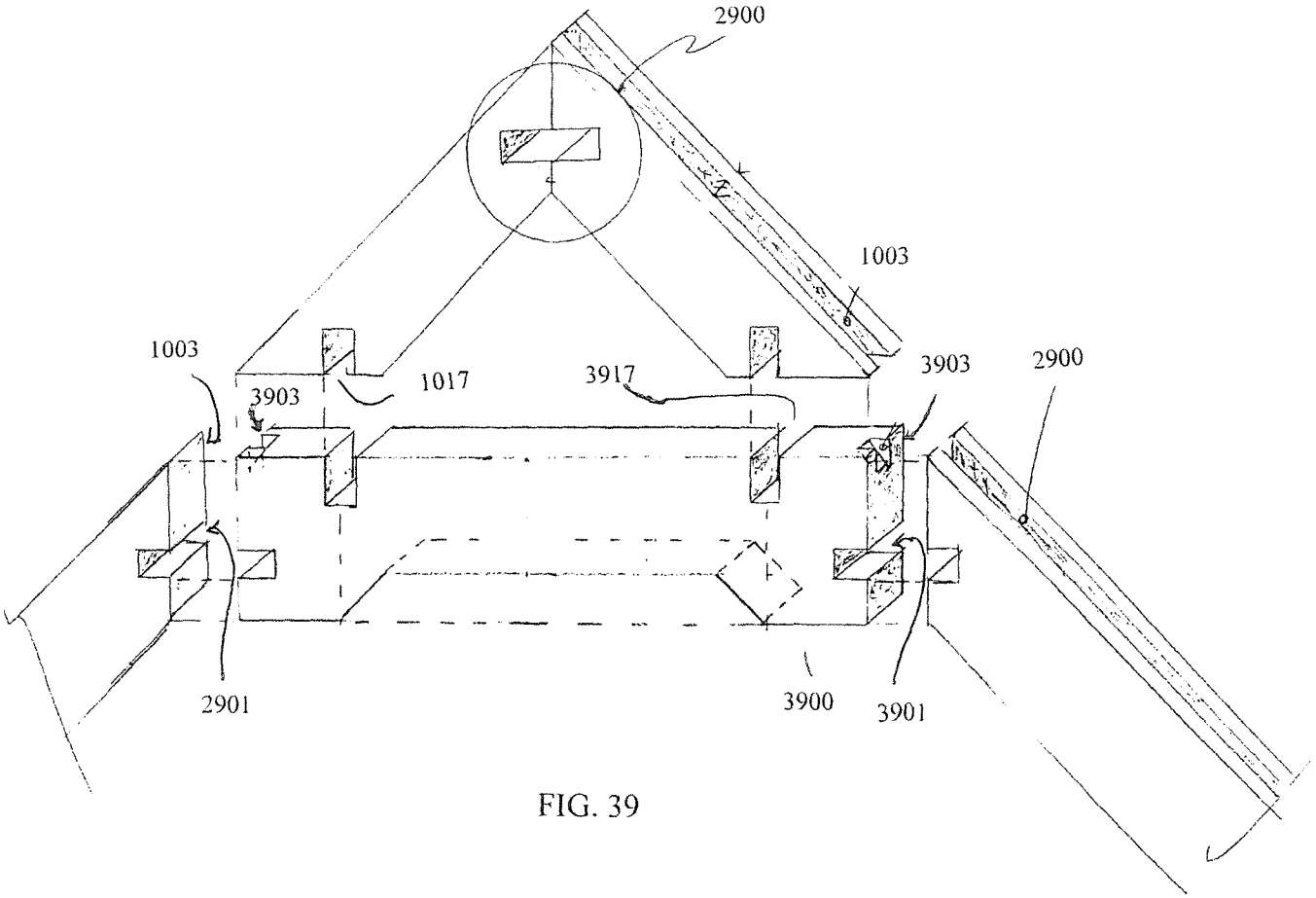
FIG. 39 shows an embodiment of a variable size roof truss log.

The interlocking rafter (2900) also includes a second slot (2911). The second slot is designed to house a hip beam (2921) as shown in FIG. 29B to provide still additional strength to the rafter structure and which can be used to connect to the slot (2311) in a hip rafter (2600) to support the hip rafters (2600) and the interlocking rafter (2900) between the hip rafters (2600) to the other interlocking rafters (2900). The rafter (2900) may also include a pitch cut (2905) to allow for better integration of the top of the rafters with each other in a hip roof Use of the interlocking rafter (2900) as shown in FIG. 29A in conjunction with a truss (3900) allows for the roof to be extended to allow the roof to cover a longer distance. It should be apparent that the rafters (1000) and (2900) can only provide a roof to a structure of a certain width. As shown in FIG. 39, this width can be extended using a truss (3900). As shown in FIG. 39, the truss (3900) includes two opposing slots (3901) and (3917). The truss (3900) is placed between two rafters (2900) that are too short to reach and touch at their end faces (1003) as shown in FIG. 29A. In this case each end face (1003) is placed against a face of the truss (3903) and the slot (2901) is aligned with the slot (3901). These slots arc connected together using a board or preferably a half log (200) as contemplated above. A second set of rafters (2900) is then placed on top of the truss with the slot (1017) which is designed to align with the rail (1117), now aligning with the slot (3917). A board or half log (200) is then placed in the slots (1017) and (3917) to support the second layer of rafters (2900).

As can be seen in FIG. 39, this allows for much wider buildings to be made and particularly allows for buildings that are wider than the longest basic log (100) as roofs of variable width can now be created. Further, as the truss (3900) of the FIG. 39 can be made of different lengths, and multiple trusses (3900) can be interconnected together by placing two faces (3903) adjacent and placing a hoard of half log in now opposing slots (3901), the size of roofs is now near limitless.

Figure 30:
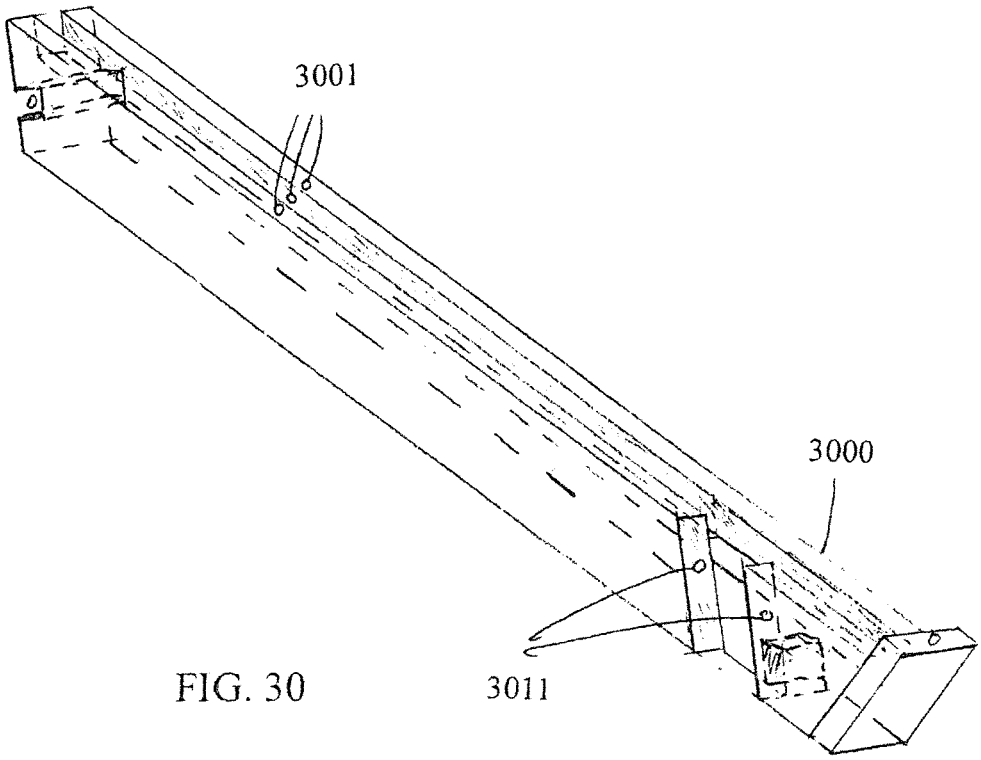
FIG. 30 shows an embodiment of a dormer rafter log with a dormer groove.
Figure 31:
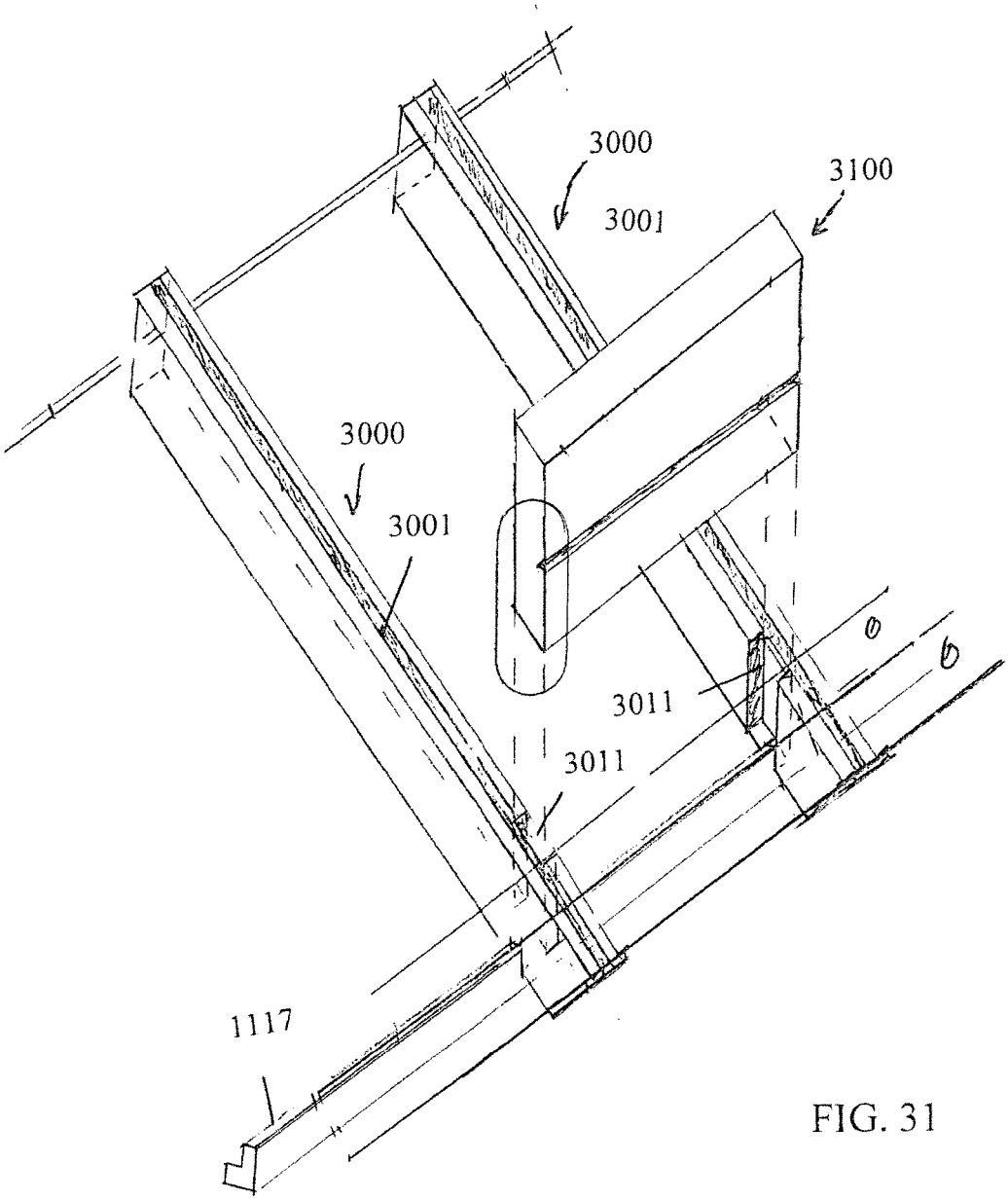
FIG. 31 shows an embodiment of two dormer rafters and a dormer faceplate being positioned to begin a dormer structure in a roof.

One thing to note from FIGS. 29A and 39 is that the rafters (2900) shown in these also include a dormer slot (3001). The dormer slot (3001) is designed for attachment of a dormer roof as discussed primarily in conjunction with FIGS. 31-34. This is not strictly required but provides for still additional functionality. A roof rafter called a dormer rafter (3000) which is effectively the rafter (1000) of FIG. 10 with a dormer slot (3001) and dormer faceplate slot (3011) placed therein is shown in FIG. 30. These two structures allow for connection of the various dormer components as discussed in conjunction with FIG. 31 through 34. However, the other roof rafters, such as rafter (2900) can include dormer slots to provide for additional functionality with fewer pieces.

Figures 28A, 28B, 28C:
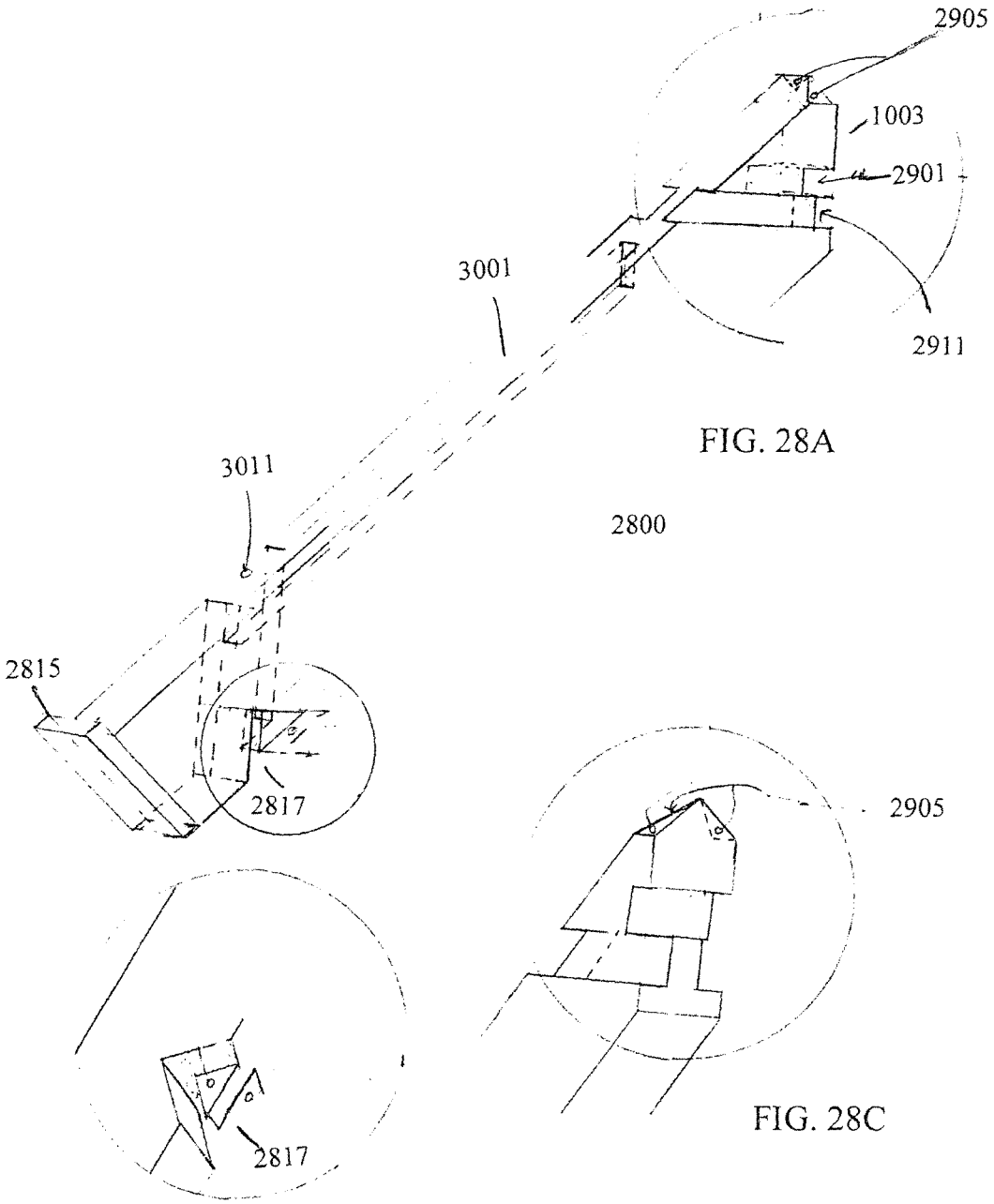
FIGS. 28A, 28B, and 28C show various images of an embodiment of a universal rafter log with components to make it a rafter, hip rafter, and dormer rafter.

The reduction in the necessary number of roof pieces is taken to an extreme in the embodiment of FIGS. 28A, 28B, and 28C. The rafter (2800) is designed to be a universal rafter and, thus, may include any or all the components of any or all the basic rafter (1000), interlocking rafter (2900), dormer rafter (3000), and or hip rafter (2600). The universal rafter (2800) in FIGS. 28A-28C includes a dormer slot (3001) as well as a dormer faceplate slot (3011). The universal rafter (2800) will commonly come in two different "sides" with the dormer faceplate slot (3011) arranged either as shown in FIG. 28A or on the opposing face forming a universal rafter which is a mirror image of FIG. 28A. It is possible for a universal rafter (2800) to include dormer faceplate slots (3011) on both sides, but this can present a point of concerning weakness due to a large amount of slots interacting right where the dormer faceplate slots (3011) are.

The universal rafter (2800) also includes pitch cuts (2905) to allow it to be used as an interlocking rafter (2900). It further includes slots (2901) and (2911) as shown in detail in FIG. 28C for connection as a gable or truss as shown in FIGS. 29 and 39. The slot (2817), as best shown in FIG. 28B, will generally also allow for connection to the rail (1117) or truss slot (3917). It should be recognized that the universal rafter (2800) as depicted in FIG. 28, is not intended to act as a hip rafter (2600) as the slot (2817) and the face (1003) are not cut at angles and the extension (2815) has a single flat face. However, in an alternative embodiment, these structures may be angled and provided as shown in FIG. 26 to provide for an alternative embodiment of the universal rafter (2800).

While the above has discussed a variety of roof structures and one of ordinary skill in the art would understand that the various rafters and rafter structures provided can be used to build a large variety of roofs, another unique "roof" structure which can be built using the building toy as described herein is a dormer. A dormer is a common architectural structure where a window is positioned within an attic or upper room and therefor extends beyond the traditional roof and has a roof itself generally perpendicular to the roof from which it extends. As discussed previously, a dormer rafter (3000), such as that shown in FIG. 30, will generally include two slots, a dormer slot (3001) which is used to connect a dormer starter (3200) and dormer logs (3300), and the dormer faceplate slot (3011) which is used to connect to the dormer faceplate (3100).

The dormer faceplate (3100) is designed to resemble a small stack of logs and serves as the starting point of the dormer structure on the front. The initial sides of the dormer are provided by a dormer wall starter (3200) as shown in FIGS. 32A through 32D. The concept between the two starter components (3200) and (3100) is that these when interacting with the rafter (3000) will provide a structure the top of which is generally parallelepiped and a substantially horizontal plane. From that structure, basic logs (100) can be used in connection with dormer wall logs (3300) to expand the dormer structure upward. This can be used to form a traditional roofed dormer, but can also be used to form structures such as integrated towers.

Figure 32A:
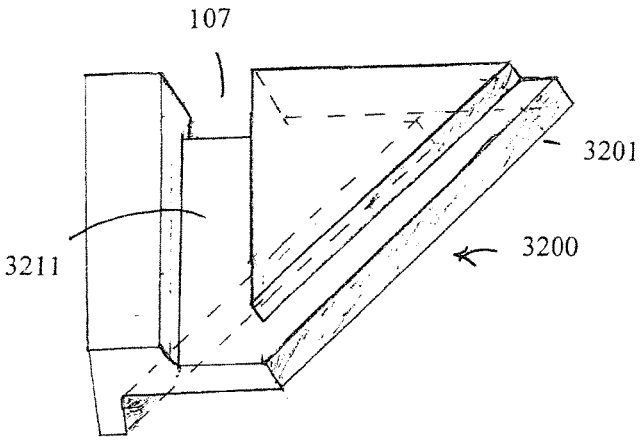
FIGS. 32A, 32B, 32C, and 32D show various views of an embodiment of a dormer wall starter piece.
Figure 32B:
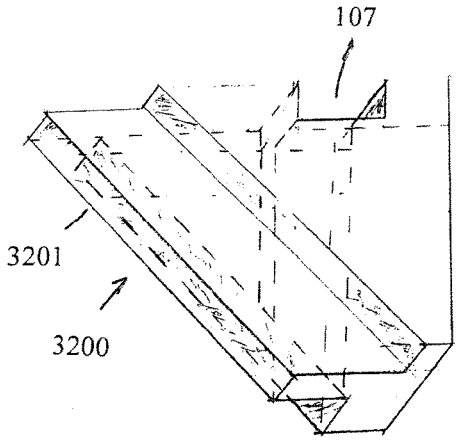
Figure 32C:
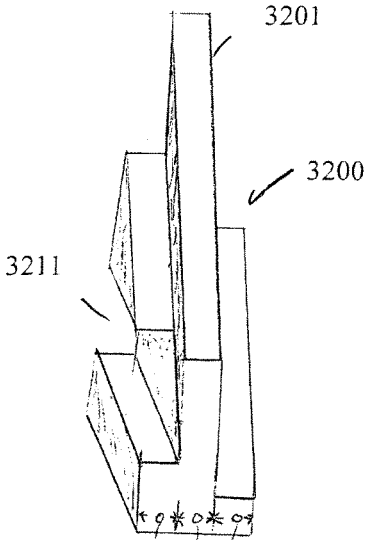
Figure 32D:
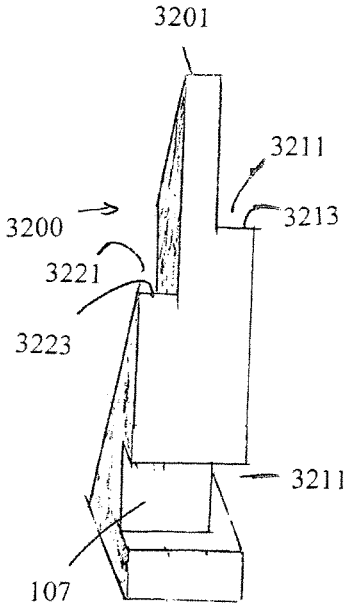

The dormer wall starter (3200) is primarily shown in the various views of FIGS. 32A-32D generally is in the form of a right triangle and includes a tongue (3201). The tongue (3201) will interface with the dormer groove (3001) to hold the dormer wall starter (3200) in place in position generally co-planar with the dormer rafter (3000). The dormer wall starter (3200) also includes a slot (3211) which will be aligned with slot (3011) to interlace with the dormer faceplate (3100). As can be best seen in FIGS. 32B and 32D, the tongue (3201) is not of even depth on both sides. The dormer starter (3200) will actually usually have a shallow side (3211) and a deep side (3221). The shallow side (3211) will generally be positioned internal to the dormer (behind the dormer faceplate (3100)) and thus will be on the same side of the dormer starter (3200) as the slot (3211). The shallow side (3211) will generally be sized and shaped so that when the tongue (3201) is placed in the dormer slot (3001), the shallow side (3211) contacts the rafter (300) both with the tongue (3201) in the slot (3001) and the face (3213) against the structure of the rafter (3000). The tongue (3201) of FIG. 32D is somewhat elongated to show this element more clearly.

The deeper side (3221) is designed to face outward of the dormer structure (away from the faceplate (3100) and is thus on the opposing side of the slot (3211). The deeper side (3221) is designed to provide a gap between the face (3223) from the structure of the rafter (3000). This gap will generally be of sufficient size to allow for a roof slats (900) to fit into the gap when the roof slats (900) are arranged as shown in FIG. 9. This provides for a cleaner connection and integration of the dormer structure with the main roof. As should be apparent from the above discussion, while FIGS. 32A through 32D provide for an embodiment of a dormer starter (3200), this only shows the starter (3200) for one side of the dormer structure. Generally, there will be a piece of mirror image (specifically based on the images of FIGS. 32C and 32D) which will be used to start the other side of the dormer.

Figure 33:
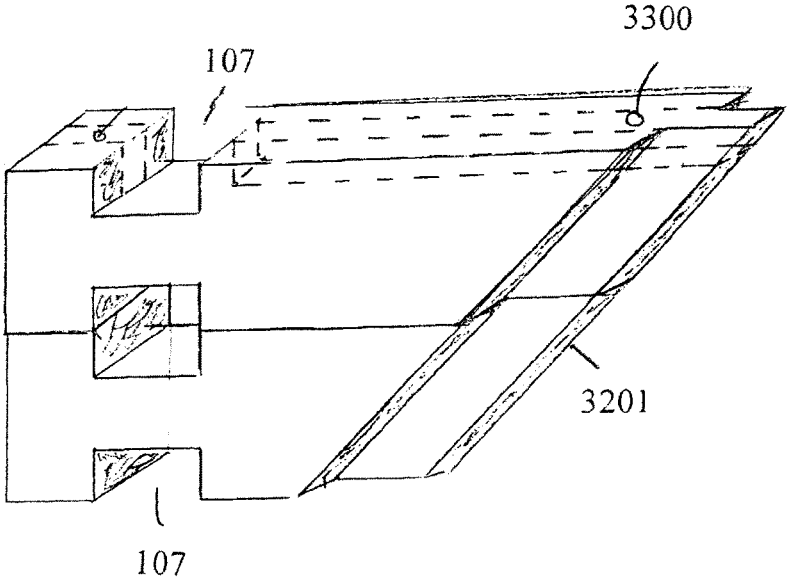
FIG. 33 shows an embodiment of two dormer wall logs on top of each other as they will be positioned in constructing the side of an embodiment of a dormer.

Placement of the dormer faceplate (3100) and the dormer starters (3200) onto the dormer rafters (3000) will generally provide for an upper surface of the dormer structure which is generally horizontally planar and will resemble the arraignment of a stack of basic logs (100). Specifically, the dormer starters (3200) each include a trough (107) and the dormer faceplate (3100) will be sized in the vertical dimension (D) in FIG. 31 so that the interaction between them is designed to have a basic log laid between the troughs (107) in the standard fashion discussed previously. To make the dormer structure taller, dormer logs (3300) as shown in FIG. 33 are used. The dormer logs (3300) will generally be of a variety of lengths corresponding to the angle of the roof dormer (3000 form the horizontal. FIG. 33 shows two dormer logs arranged above each other. As can be seen, each dormer log (3300) includes a trough (117) of the standard design and also includes a tongue (3201) of the same structure as the dormer starter (3200). These dormer logs (3300) thus are used to form the side walls of the dormer structure. Basic logs (100) and other logs may be used to construct the front face (and to include other structures such as openings for windows) in the face in the fashion of constructing any other structure.

Figure 34:
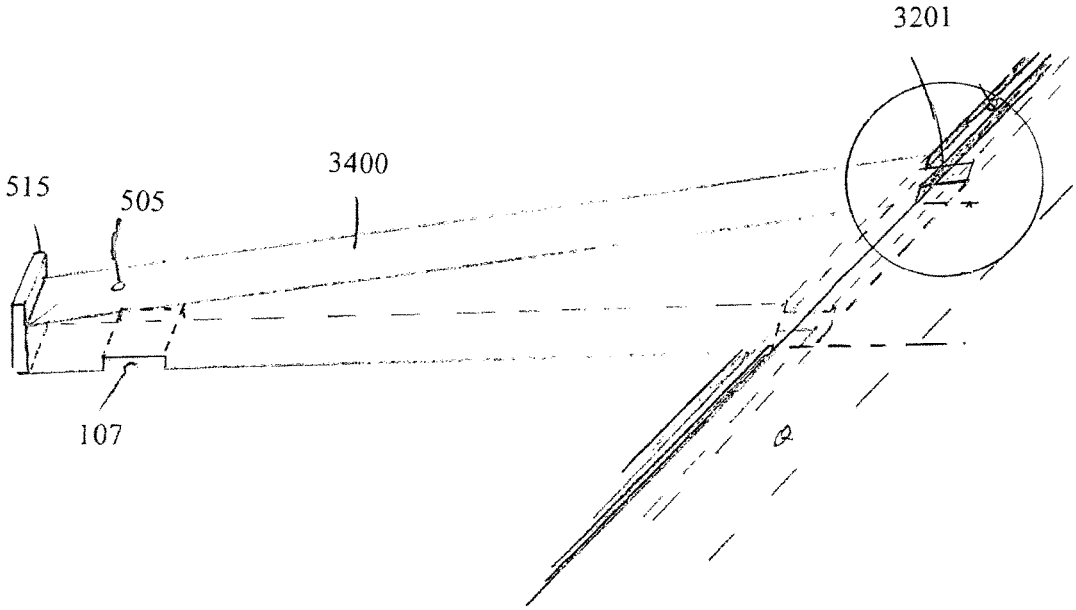
FIG. 34 shows an embodiment of a dormer roof gable log connected to the dormer groove of a dormer rafter log such as that of FIG. 30.

To provide a roof for the dormer, a standard rafter (1000) or (2900) structure of appropriate size may be used. Alternatively, a dormer roof support (3400) as shown in FIG. 34 may be provided to allow the dormer roof to slant the same general direction as the main roof but at a different angle. The dormer roof (3400) will generally be similar to about half a gable (500) as shown in FIG. 4, but will include a tongue structure (3201) as shown in FIGS. 32 and 33. The top (505) is again constructed to hold roof slats (900) and the extension (515) may be provided to keep them in place. A trough (107) on the underside allows for the dormer roof (3400) to interact with the basic logs (100) and dormer logs (3300) in the traditional fashion.

It should be apparent from the above that a very large variety of roofs can be built form the pieces shown in the present FIGS. In particular, roofs can be built including standard two sided sloped triangular roofs, hip roofs, partial hip roofs such as those that exist on an L-shaped building, and dormers in roofs and dormer roofs of a variety of shapes may be constructed. Further, through the use of truss (3900), the roofs can be of virtually any size. One thing all the above roofs have in common, however, is that they are generally on top of the building structure. The roofing components of FIGS. 35-38 are designed to allow roofs to extend from the side of a structure as is the case for awnings and porches for example. In these kinds of roofs, which are called extension roofs herein, the key element is that the roof will generally abut a wall made of basic logs (100) as opposed to being on top of the structure.

Figure 35:
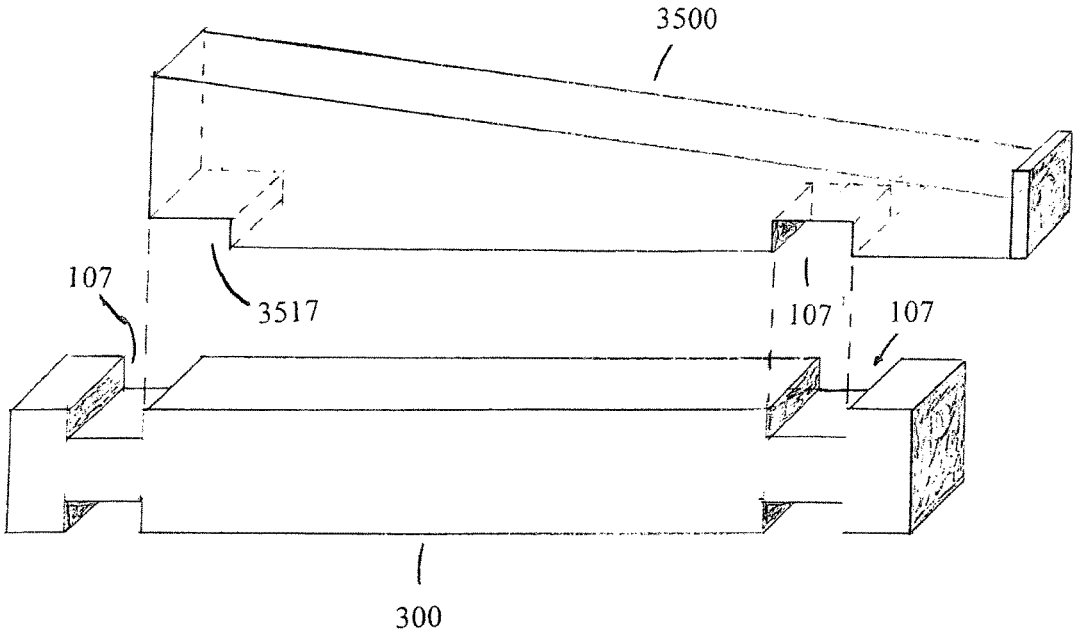
FIG. 35 shows an embodiment of an extension roof gable log in relation to a basic log such as that of FIG. 1A.

FIG. 35 shows an extension gable (3500) used in an extension roof. The extension gable (3500) is shown in size comparison against a special log (300) to indicate how, when the troughs (107) of the extension gable (3500) and special log (300) are aligned the extension gable (3500) only extends to the edge of the other trough (107) of the special log (300). Gable (3500) may include a special trough (3517) allowing it to go over an end (103) and (105) of a special log (300) but this is not required. However, the shape and size of the extension gable (3500) slows it to sit flush against a wall that the special log (300) is extending from. A special log (300) will generally be used to attach the extension to the exterior wall of the main structure.

Figure 36:
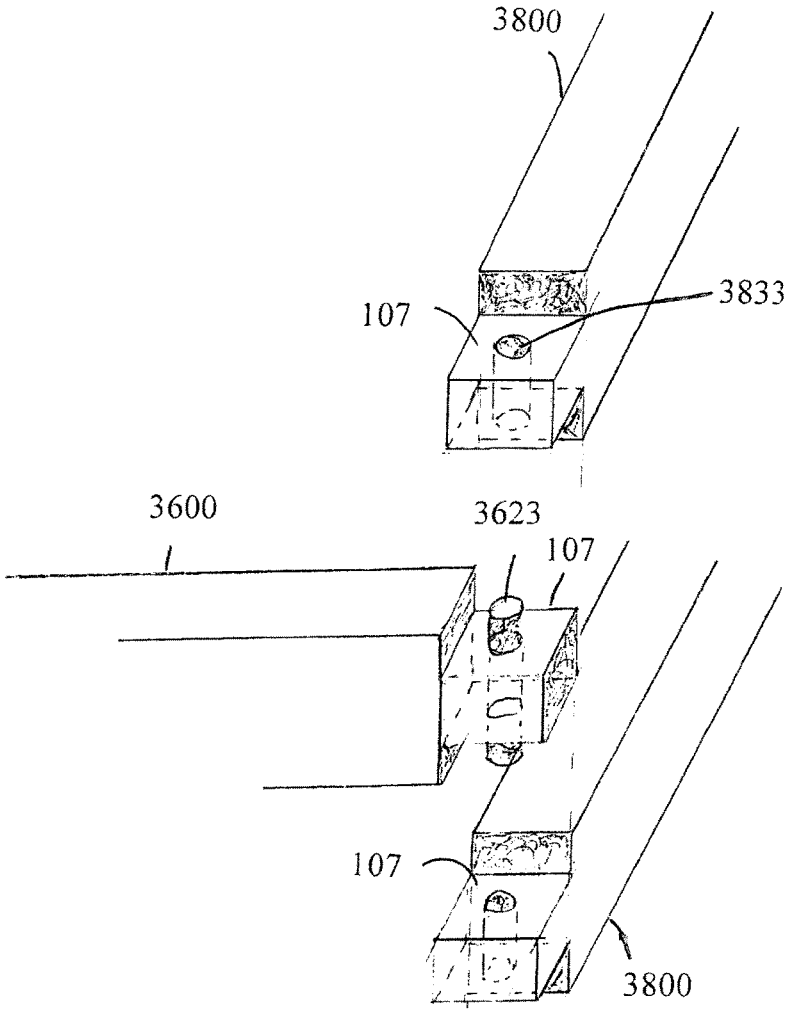
FIG. 36 shows an embodiment of forming an open corner using a pin log and hole log.
Figure 38:
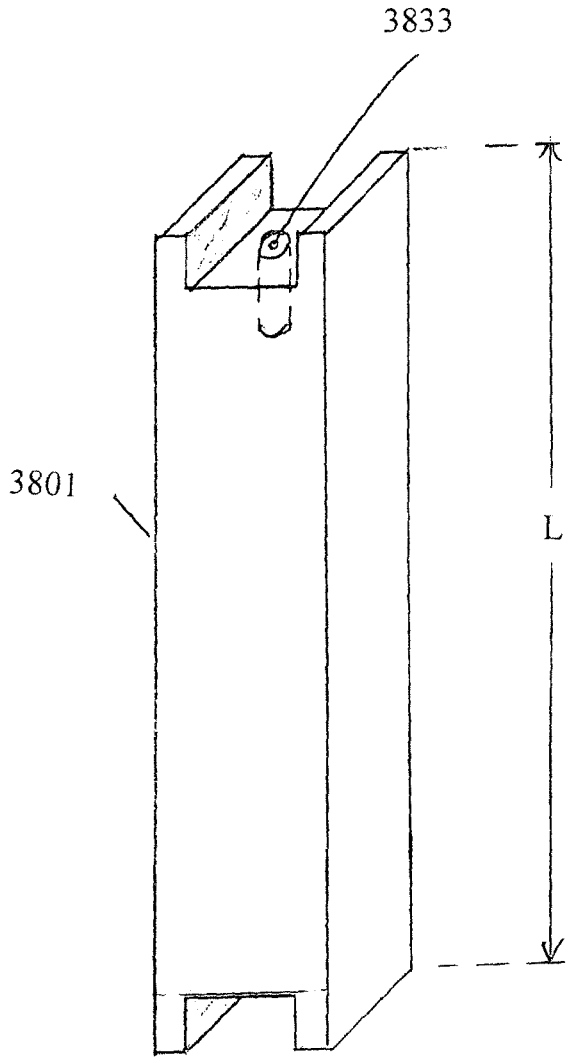
FIG. 38 shows an embodiment of a pillar for vertical support of an open corner such as that of FIG. 36.

To build an open patio, porch, or similar structure with a roof but minimal walls, the building logs of FIGS. 36 and 38 are used. These logs come as pin logs (3600) and hole logs (3800) which include a pin (3623) and a hole (3833) respectively. The pin log (3600) and hole log (3800) are effectively basic logs (100) and/or special logs (300) which have no ends (103) or (105) beyond the trough (107). They, thus, use the pin and hole structure discussed previously in conjunction with FIG. 24 to more securely attach the adjoining logs at the troughs (107). In this arrangement, the logs (3600) and (3800) are very similar to the band boards (2301), (2311) and (2321) but do not include the rail (1117). To build an extension roof, a hole log (3800) will generally be positioned to extend outward from the wall of the structure interacting the troughs (107) from two vertically arranged logs of the structure at a certain height where the roof is generally intended to be. Pin (3600) and hole (3800) logs may then be used to construct the support beams and basic pattern of the extension roof. This will often correspond to the positioning of half logs (200) which extend from the base of the structure or may correspond with various floor support logs positioned at or near the base of the structure to provide for a floor to the patio or porch.

To provide for strength, at various points along the logs 3600) and (3800) pillars (3801) or various lengths (L) may be provided. These will generally include a hole (3833) in a trough (107) which can interact with a pin (3623) so as to interconnect with the trough (107) of a pin log (3600) as necessary. The pillars (3801) will thus provide for vertical support of the pin (3600) and hole (3800) logs which are usually spaced above any other surface and therefore may act as lever arms if not well supported. The combination of the pillars (3801), pin logs (3600) and hole logs (3800) will generally produce a structure with a parallelepiped structure, but minimal walls. This is akin to a porch. It should also be recognized that the pin logs (3600) and hole logs (3800) can also be used within a structure to provide for a closed corner wherever that may be desired. For this reason, FIG. 36 does not show the other ends of the pin (3600) and hole (3800) logs as the structure of FIG. 36 would be placed on any of the other logs contemplated herein.

Figure 37:
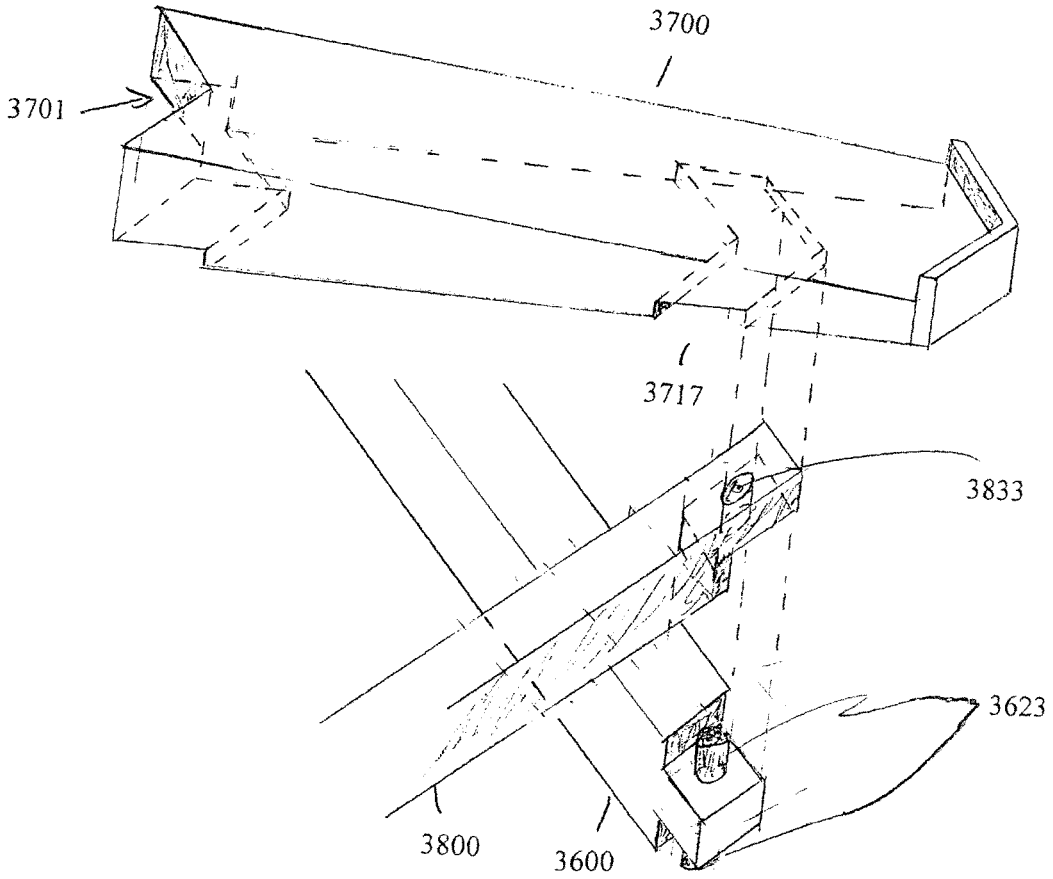
FIG. 37 shows an embodiment of an extension roof corner gable being positioned over an open corner as provided in FIG. 36.

To roof in the porch, the extension gables (3500) will generally positioned along any logs that extend outward from the main structure to the pin log (3600) and hole log (3800) construction. Should there be a corner (e.g. were the extension roof will wrap around a corner of the main structure) an extension corner gable (3700) as shown in FIG. 37 will typically be used. The extension corner gable (3700) includes a cutout (3701) which is designed to interface with a corner of the structure. This may be specifically adapted to go over ends (103) and (105) or may be designed to be flush and positioned over a closed corner such as is created by use of pin (3600) and hole logs (3800) or band hoards (2301), (2311), (2321), (1100), and (1110). The extension corner gable (3700) will also include a slot (3717) sized and shaped to go over a corner produced by the interaction of a pin log (3600) and hole log (3800) as shown in FIG. 37. With the extension gables (3500) and the extension corner gables (3700) in place, roof slats (900) may be positioned thereon in the same fashion as is contemplated in FIGS. 9 and 13.

Figure 14:
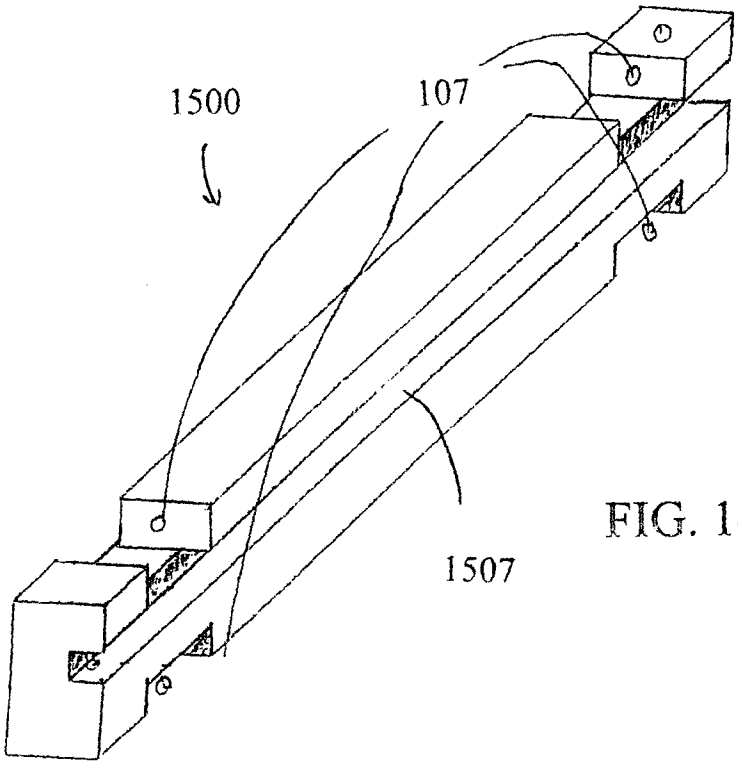
FIG. 14 shows an embodiment of a log for supporting a floor.
Figure 15:
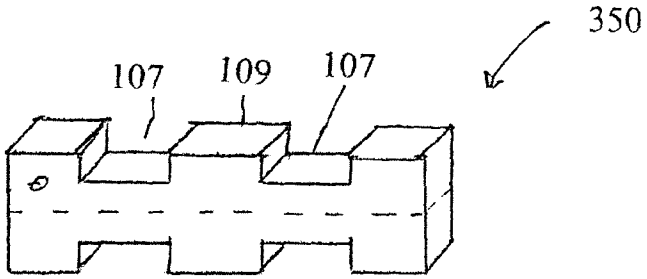
FIG. 15 shows an embodiment of a log for the construction of a chimney or other attached small structure.
Figure 16:
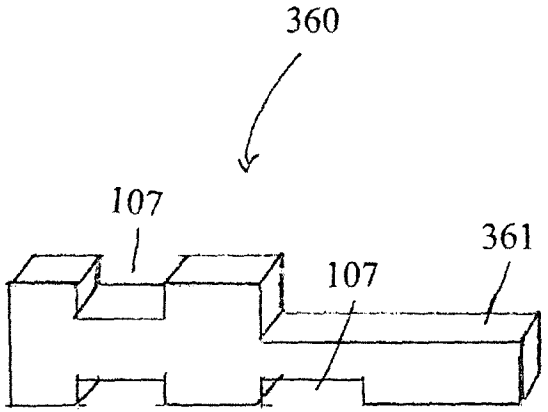
FIG. 16 shows an embodiment of a log for supporting a fireplace mantle.
Figure 17:
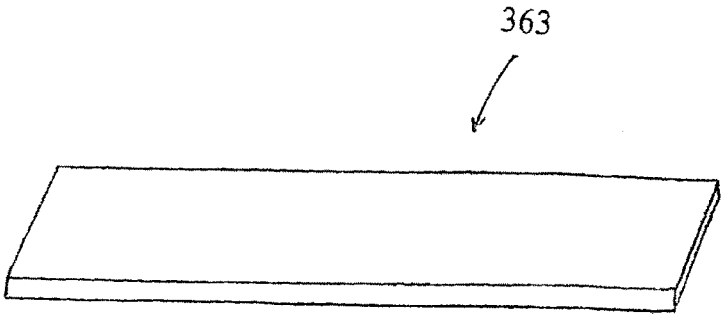
FIG. 17 shows an embodiment of a mantel piece.
Figure 18:
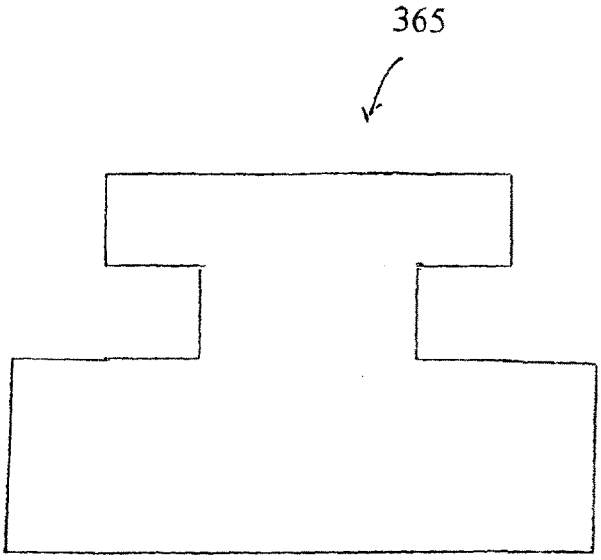
FIG. 18 shows an embodiment of a hearth piece.

FIG. 14 provides for a floor support log (1500). The floor support log (1500) is designed to allow for an internal floor to be provided to a structure. The floor support log (1500) is against generally sized and shaped to the same dimensions as at least one size of basic log (100). It also has notches (107) in the same generally position, and on opposing sides, as the basic log (100). The floor support log (1500), however, includes a channel (1507) on one of the non-notched sides (into its width). This channel (1507) is configured to hold floor panels of the type contemplated above, or the interlocked roof slats (900) as contemplated above to form a floor.

As the floor support log (1500) is essentially interchangeable with a basic log (100), it allows for a floor to be placed anywhere in a structure by simply providing two floor support logs (1500) at opposing positions with their channels (1507) both facing inward. It should also be apparent that while the channel (1507) is intended to support a floor internal to a structure, reversing the floor support log (1500) to place the channel (1507) external to the structure, allows a user to build an awning, deck, bridge, or similar structure.

Figure 40A:
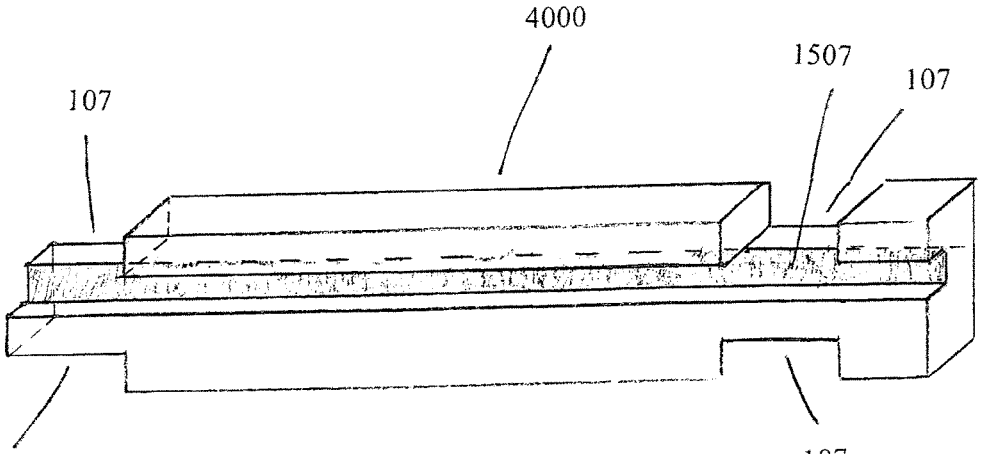
FIGS. 40A and 40B show alternative embodiments of floor support logs.
Figure 40B:
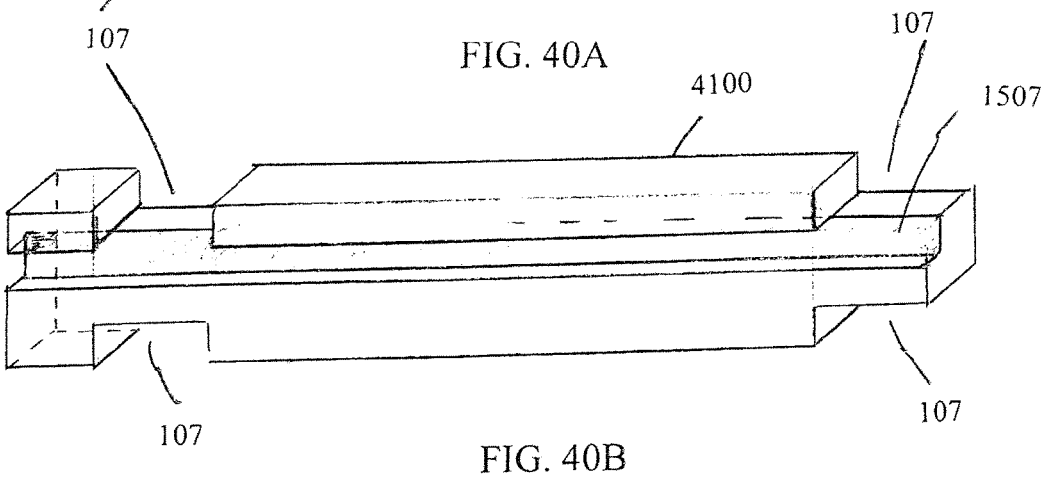

FIGS. 40A and 40B provide for alternative floor support logs (4000) and (4100). These logs eliminate one end (either (103) or (105) to allow for a closed corner to be made at a floor level. The floor support logs (4000) and (4100) can be used to create a closed corner, and/or to form a flat face form an internal position. However, they are not shown with a pin and hole construction. This is to illustrate that the pin and hole arrangement is not necessary in all closed corner pails. However, in an alternative embodiment, the floor support logs (4000) and (4100) may include pins and holes.

Figure 41A:
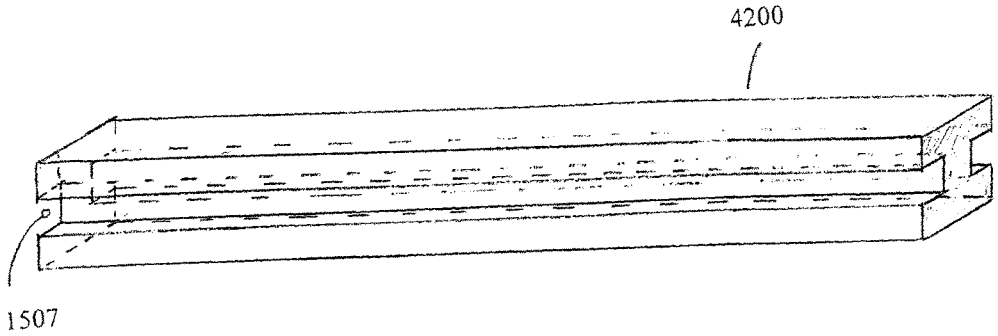
FIGS. 41A and 41B show alternative embodiments of floor support logs generally used internal to a structure.
Figure 41B:
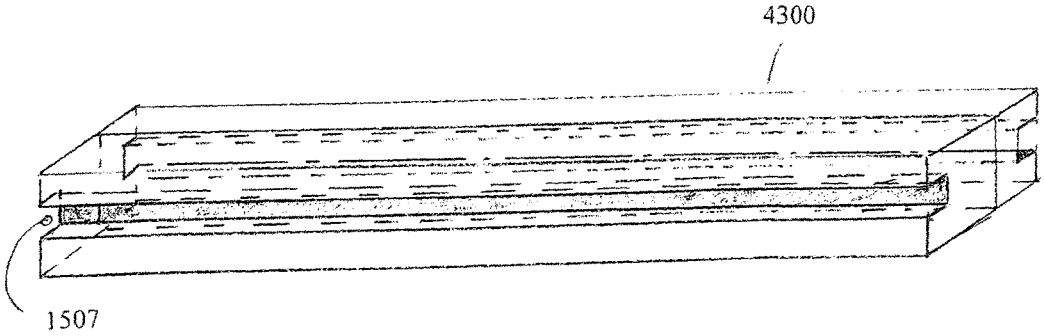

The floor support logs (4000) and (4100) can allow for the creation of attic floors as well as porch floors or floors where a closed corner is otherwise desired. Further, when the logs (4000) and (4100) are combined with the floor connector logs (4200) and (4300) of FIGS. 41A and 41B, the ability to create floors which are larger than any provided logs becomes available. Providing floor panels of various sized in conjunction with the logs of FIGS. 40A, 40B, 41A and 41B allows for a large number of floor designs to be constructed. Specifically, the logs (4000) and (4100) of FIGS. 40A and 40B along with the basic floor support log (1500) of FIG. 14 allows for a floor channel (1507) to be placed in essentially any wall structure. The logs (4200) and (4300) of FIGS. 41A and 41B provide for interconnection of floor panels internal to the structure where there is no interconnection with the walls of the structure. Thus, floors can be built which can accommodate structures which are much larger in one or both horizontal dimensions than the largest basic log (101) provided.

FIGS. 15-18 provide for specialized parts that allow for the formation of a chimney structure. A chimney is effectively simply a very small extension from a wall. The chimney connector (350) is basically a specialized basic log (100) which includes two very closely positioned notch (107) pairs. The center portion (109) is generally sized so that is the same size as the end portions on each end after the notches (107). The chimney connector (350) therefore allows for small extension in a wall by placing two chimney connectors (350) at end notches (107) of two basic logs (100) each one third the length of the basic log forming the opposing wall (assuming a center chimney), The top of the chimney on the interior is created with a mantel piece (360) which simply provides a mantel shelf (361) in place of one of the notches and cutting through one end. The mantle shelf (361) supports a specialized flat component which is the mantle (363). While it may not be needed in all structures, a chimney built on an upper floor can generate an undesirable hole in the floor. For this reason a specialized hearth (365) piece may be provided which fills the hole and provides the appearance of a hearth in the fireplace.

Figure 19:
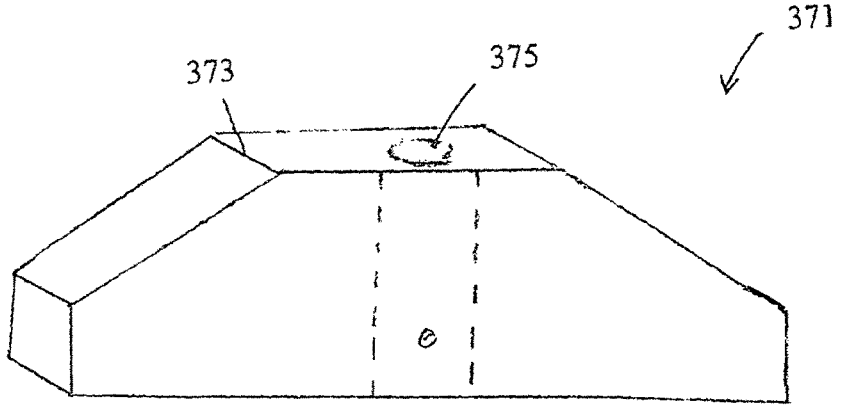
FIG. 19 shows an embodiment of a piece for transitioning a fireplace construction into a chimney.
Figure 20:
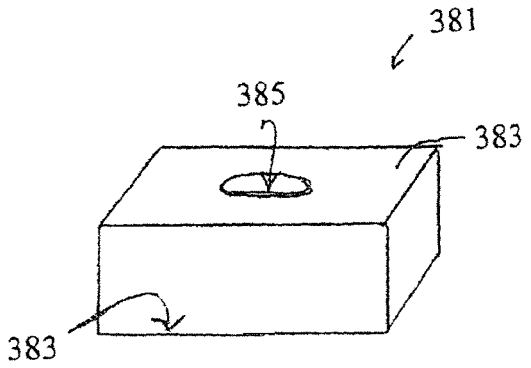
FIG. 20 shows an embodiment of a piece for forming a chimney.

FIGS. 19 and 20 provide for an embodiment of exterior chimney components. These would generally be placed external to the structure on the top of a chimney built using the chimney connector (350). However, in an alternative embodiment, they may be used to form an interior chimney as well (if the fireplace is internal). FIG. 19 provides for the chimney transition piece (371) which transitions form the fireplace to the flue. The transition (371) is generally roughly trapezoidal in shape with removed corners. In an embodiment, the angles of the angles sides are intended to correspond to the angles of a gable (500) to allow the transition to align with, or be part of, a roof. The top (373) of the transition (371) will generally include a center hole (375), which often does not penetrate all the way through the bottom surface, for supporting a cylindrical dowel rod or similar component to give the chimney increased strength.

Figure 21:
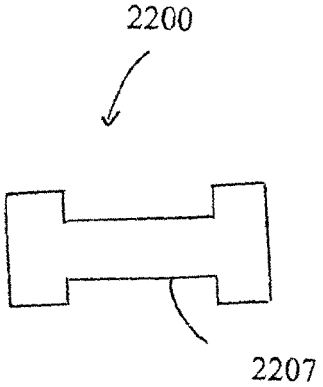
FIG. 21 shows an embodiment of a piece for making a bay window.

Chimney blocks (381) are shown in FIG. 21 and will generally also include a bole (385) however this hole (385) will generally run all the way through the chimney block (381) from both opposing sides. To construct the chimney, any number of chimney blocks (381) will be threaded onto a dowel rod placed in the hole (375) in the transition and moved down to rest on the top surface (373) of the transition (371). Generally, the chimney blocks will have major faces (383) with similar area to that of the top surface (373) so as to mesh smoothly in forming the chimney. A portion of the dowel rod may be left above the last threaded chimney block (381) to show a flue extension or stack, if desired.

Figure 22:
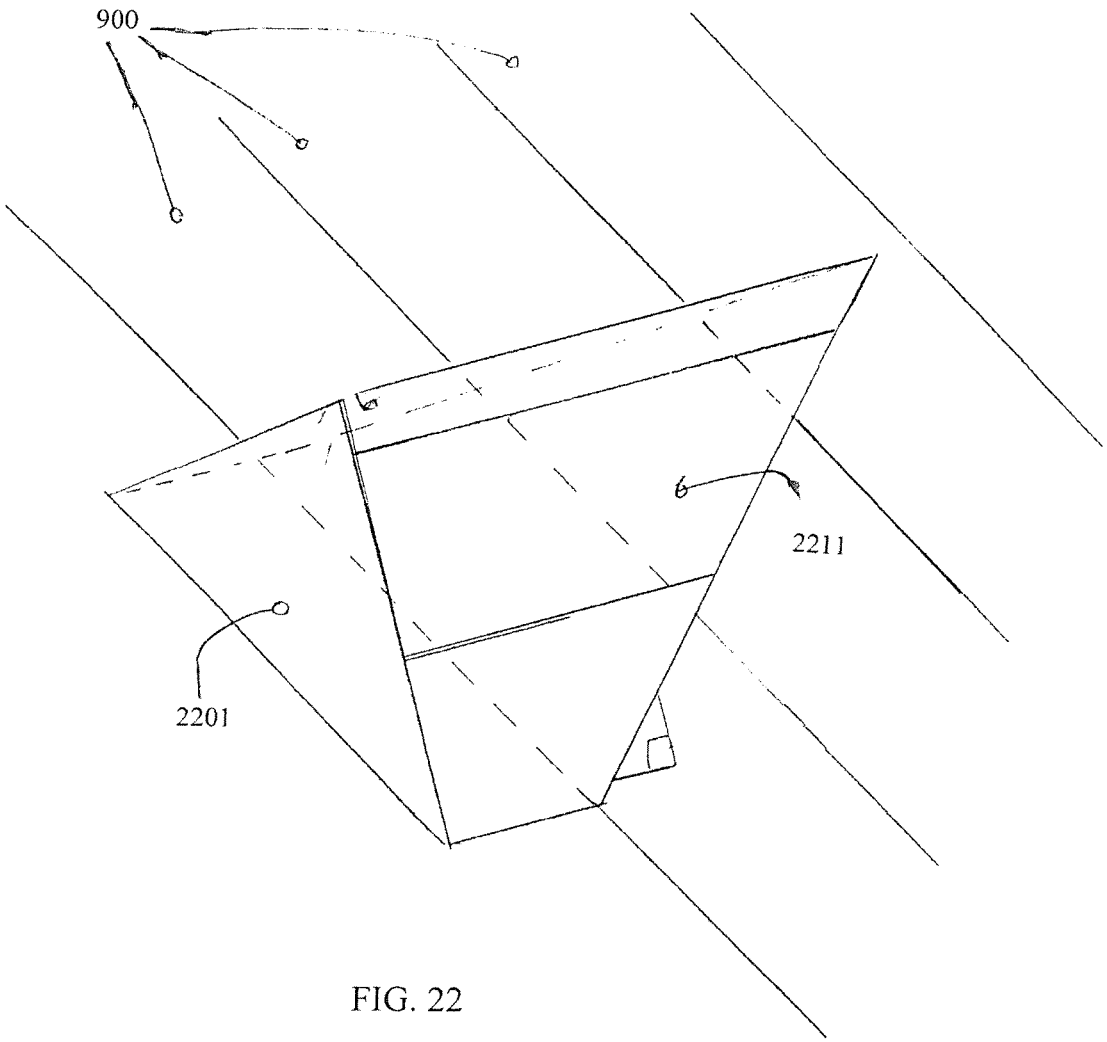
FIG. 22 shows an embodiment of a cricket piece for integrating a chimney to a roof.
Figure 42:
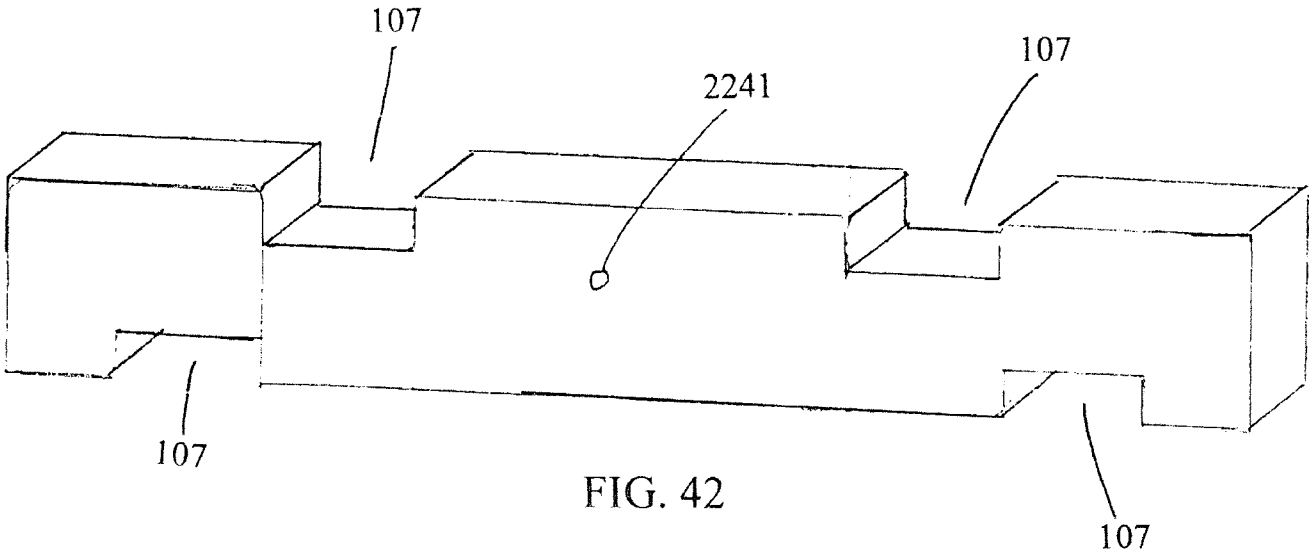
FIG. 42 shows an embodiment of an offset log which can be used to align a chimney with a dormer or otherwise to offset a structure.

FIG. 22 shows a cricket block (2211) for integrating a chimney to a roof. In this case, the chimney blocks (381) can be integrated with the roof of the structure by simply placing the cricket block (2211) onto the roof slat (900) with the face (2201) against the chimney blocks (381). FIG. 42 provides for a chimney transition piece (2241) which can be used to assist in tying a fireplace at to lower floor into a dormer constructed using a dormer rafter (3000) as contemplated in FIG. 31. The chimney transition log (2241) includes four troughs (107) of the standard size and is generally proportioned as a basic log (100). However, the troughs (107) on the bottom are spaced at a greater distance than the troughs (107) on the top of the log. This allows for the fireplace (which is offset outside the wall of the structure) to effectively be shifted back into line with other components. The cricket block (2211) may be used to close the hole on the roof side. As should be apparent, the chimney transition log (2241) can also be used for other adjustments of positions as the troughs (107) on the top will generally correspond to the length of one size of basic log, while the troughs (107) on the bottom will generally correspond to another. The chimney transition log (2241) of various sizes could also be used to make stepped pyramidal structures and other similar designs.

FIG. 21 provides for one additional log which is a bay window log (2200). The bay window log (2200) allows for basic logs (100) to be placed side-to-side at their non-notched sides (double width). To accomplish this, the bay window log (2200) includes a long notch (2207). This long notch (2207) has the same length as two notches (107) and therefor allows for Two basic logs (100), or any other logs, to be positioned side-by-side horizontally.

As should be apparent from the description above, the building, toy discussed herein provides for a much greater variety of structures to be built with the inclusion of only a relatively small number of specialty parts. This provides for a log-style building toy with much more flexibility than has previously been available.

While the invention has been disclosed in connection with certain preferred embodiments, this should not be taken as a limitation to all of the provided details. Modifications and variations of the described embodiments may be made without departing from the spirit and scope of the invention, and other embodiments should be understood to be encompassed in the present disclosure as would be understood by those of ordinary skill in the art.

The invention claimed is:

1. A log-style building toy comprising:

at least two basic logs, each of said basic logs being generally in the form of an elongated parallelepiped with two opposing ends and tout sides giving it a width, height, and length; the basic log including at least four notches arranged therein, said four notches being arranged as two pairs of notches with each of said pairs of notches arranged toward said opposing ends, each of the notches in each pair of notches being arranged on opposing sides of said basic log, and at least four roof rafters and two band boards, where said roof rafters can be positioned as two opposing pairs on said band boards to form roof gables;

wherein, all of said notches in said basic logs are configured to extend a depth of one quarter of the height of the basic log into the basic log into which they are formed;

wherein said notches are designed to interlock with each other when said notches are aligned and said logs with said aligned notches are placed generally perpendicular to each other; and wherein each of said two opposing pairs of roof rafters includes a slot towards a peak when formed into said roof gables, said slot being sized and shaped to accommodate a structure half as thick as said basic log at said pair of notches.

2. The building toy of claim 1 wherein at least one of said at least four roof rafters is a dormer rafter having an elongated slot therein, said elongated slot being sized and shaped to mate with a dormer log having a tongue on one end thereof.

3. The building toy of claim 1 wherein at least one of said at least four roof rafters is a hip rafter, said hip rafter intersecting, at least one of said band boards at a non-perpendicular angle.

* * * * *